United States Patent [19]

Furukawa

[11] Patent Number: 4,798,772

[45] Date of Patent: Jan. 17, 1989

[54] STEEL SHEETS FOR PAINTING AND A METHOD OF PRODUCING THE SAME

[75] Inventor: Kusuo Furukawa, Tokyo, Japan

[73] Assignee: Kawasaki Steel Corporation, Kobe, Japan

[21] Appl. No.: 948,122

[22] Filed: Dec. 31, 1986

[30] Foreign Application Priority Data

Jan. 17, 1986 [JP] Japan ..... 61-7769
Nov. 25, 1986 [JP] Japan ..... 61-278876

[51] Int. Cl.[4] ..... B21D 53/00

[52] U.S. Cl. ..... 428/600; 428/687; 428/925; 72/199

[58] Field of Search ..... 428/687, 600, 601, 923, 428/684, 679, 925; 29/121.1, 121.8; 72/199

[56] References Cited

U.S. PATENT DOCUMENTS

| | | | |
|---|---|---|---|
| 2,991,544 | 7/1961 | Gotsch et al. | 428/687 |
| 3,619,881 | 11/1971 | Bulls et al. | 428/600 |
| 3,623,850 | 11/1971 | Horvath | 428/687 |
| 4,071,657 | 1/1978 | Rault | 428/646 |
| 4,200,382 | 4/1980 | Friedman | 29/121.1 |
| 4,679,288 | 7/1987 | Mongant et al. | 29/121.8 |

FOREIGN PATENT DOCUMENTS

| | | | |
|---|---|---|---|
| 157754 | 10/1985 | European Pat. Off. | 29/121.8 |
| 2840702 | 4/1979 | Fed. Rep. of Germany . | |
| 2476524 | 8/1981 | France . | |
| 8330 | 4/1979 | Japan | 428/687 |
| 1045641 | 10/1966 | United Kingdom . | |
| 2040824A | 9/1980 | United Kingdom | 219/121 LM |
| 2069906A | 9/1981 | United Kingdom | 219/121 LM |

OTHER PUBLICATIONS

Cahiers d'Informations Techniques de la Revue de Metallurgie, vol. 80, No. 5, May 1983, pp. 393–401, Paris, Fr., J. Crahay et al; "Gravure de la Rugosite des Cylindres de Laminoir par Impulsions Laser".

*Primary Examiner*—John J. Zimmerman
*Attorney, Agent, or Firm*—Balogh, Osann, Kramer, Dvorak, Genova & Traub

[57] ABSTRACT

A painting steel sheet having an improved distinctness of image after painting has such a surface roughness profile that a center-line average roughness is within a range of 0.3–3.0 μm and a microscopic shape is comprised of mountain portions, groove-like valley portions and middle flat portions satisfying particular dimension relations, and is produced by temper rolling a steel sheet at a draft of not less than 0.3% with work roll dulled to particular dimensions through a high density energy source.

3 Claims, 23 Drawing Sheets

| Surface Roughness of Roll #50 |
|---|
| Kind of Roll Discharge Worked Roll |
| Ra 1.0 μm |
| PPI 142 |

Three - Dimensional Profile

| |
|---|
| Surface Roughness of Roll #50 |
| Kind of Roll Shot Blast Roll |
| Ra 1.0μm |
| PPI 164 |

Three - Dimensional Profile

STEEL SHEETS FOR PAINTING AND A METHOD OF PRODUCING THE SAME

BACKGROUND OF THE INVENTION

1. Field of the Invention

This invention relates to steel sheets for painting such as cold rolled steel sheets, zinc hot dipped or electroplated steel sheets and so on, which are used by the forming such as press forming or the like before or after painting process as an outer panel for automobiles or a decorative outer plate for electric appliances, and a method of producing the same.

2. Related Art Statement

As a typical example of the painting steel sheet, the cold rolled thin steel sheet is usually produced by subjecting the cold rolled steel sheet to degreasing, annealing and temper rolling in this order. In this case, the temper rolling is to improve the galling resistance in the press forming by conducting a light rolling through work rolls having a dulled surface to give a proper surface roughness to the steel sheet surface.

As a process of dulling the surface of the work roll to be used in the temper rolling, there have hitherto been practised a shot blast process and a discharge working process. When the work roll for temper rolling is subjected to a dulling according to these processes, an irregular roughness profile is formed on the surface of the work roll, and consequently the steel sheet after temper rolling indicates a rough surface comprising a plurality of irregular mountain and valley portions as shown in FIGS. 1 or 2. If such a surface roughened steel sheet is subjected to a press forming, a lubricating oil is reserved in the valley portions to reduce friction force between press mold and steel sheet and hence make the press operation easy, while metallic powder separated out by the friction force to the mold is trapped in the valley portions to prevent the galling.

Lately, the finish feeling after painting on vehicle body in passenger cars and trucks is a very important quality control item because the height in synthetic quality of automobile can directly be appealed to the eye of the user as a good finish quality. Now, there are several evaluation items on the painted surface. Among them, it is particularly important that a glossiness lessening irregular reflection on the painted surface and an image clarity defining few image strain are excellent. In general, the combination of the glossiness and the image clarity is called as a distinctness of image.

It is known that the distinctness of image on the painted surface is dependent upon the kind of paint and the painting process but is strongly influenced by the rough surface of the steel sheet as a substrate. That is, when a ratio of flat portion occupied in the steel sheet surface is small and the unevenness is much, the ratio of flat portion occupied in the painted surface becomes small and the unevenness becomes larger, and consequently the irregular reflection of light is caused to damage the glossiness and also the image strain is produced to deteriorate the image clarity, so that the distinctness of image is degraded.

In general, the roughness of the steel sheet surface is frequently represented as a center-line average roughness Ra. Further, it is known that as the center-line average roughness Ra becomes larger, the amplitude between mountain portion and valley portion becomes large and hence the unevenness of the painted surface becomes large and consequently the distinctness of image is degraded.

As a method for evaluating the distinctness of image, there have been developed various systems. Among them, a value measured by means of a Dorigon meter made by Hunter Associates Laboratory or a so-called DOI value is most usually used. The DOI value is expressed by $DOI=100x(Rs-R_{0.3})/Rs$, wherein Rs is an intensity of a specular reflected light when a light entered at an incident angle of 30° is reflected at a specular reflective angle of 30° with respect to a sample S, and $R_{0.3}$ is an intensity of a scattered light at a reflective angle of 30°±0.3°. The relation between the DOI value indicating the distinctness of image and the center-line average roughness Ra is shown in FIGS. 4 and 5. FIG. 4 is a case that a two-layer coating of 55 μm in thickness is applied to a steel sheet temper rolled with a roll dulled through the conventional shot blast process, and FIG. 5 is a case that a three-layer coating of 85 μm in thickness is applied to the same steel sheet as mentioned above. It can be understood from FIGS. 4 and 5 that as the center-line average roughness Ra becomes large, the DOI value becomes small to degrade the distinctness of image.

When the steel sheet is subjected to a temper rolling with work rolls dulled through the conventional shot blast process or discharge working process, it exhibits a rough surface comprised of irregular mountain portions and valley portions as previously mentioned, wherein the flat portion is very little. When the painting is applied to the steel sheet having such irregular mountain and valley portions, since the coating is formed along the slopes of the mountain and valley portions, the ratio of flat portion occupied in the painted surface becomes small as shown, for example, in FIG. 33 being mentioned later and consequently the distinctness of image is degraded. In the conventional shot blast process or discharge working process, such a problem can not be avoided, so that it is very difficult to provide a sufficiently improved distinctness of image on the painted surface.

SUMMARY OF THE INVENTION

Under the above circumstances, it is an object of the invention to provide steel sheets having an improved distinctness of image by improving a surface roughness profile of the steel sheet to lessen the unevenness of the painted surface after painting and increase the ratio of flat portion occupied in the painted surface so as to obtain a high specular light reflectivity and a small image strain, and a method of efficiently producing steel sheets having such an improved surface roughness profile. In other words, the invention is to provide steel sheets having a distinctness of image considerably excellent than that of the conventional one without changing the usually used paint and the painting process and a method of producing the same.

The inventor has made various studies with respect to a laser processing process different from the conventional processes as a dulling process of work roll for temper rolling and found that when the steel sheet is subjected to a temper rolling with work roll dulled through laser processing, the top of the mountain portion constituting the surface roughness becomes flat and also flat portions become so much in valley portion between the mountain portions. Such an increase of flat portions means that it is advantageous to flatten the outermost coating layer in the painting. That is, it is considered that the irregular reflection of light is little as compared with the irregularly rough surface as in the conventional shot blast or discharge worked sheet and hence the distinctness of image is improved.

The inventor has made further experiments and found a surface roughness profile of steel sheet capable of most improving the distinctness of image on the painted surface after painting, and as a result the invention has been accomplished.

According to a first aspect of the invention, there is the provision of a steel sheet for painting, characterized in that a center-line average surface roughness Ra of said steel sheet is within a range of 0.3 to 3.0 μm and a microscopic shape constituting said surface roughness is comprised of trapezoidal mountain portions having a flat top surface, groove-like valley portions formed so as to surround a whole or a part of the mountain portion and middle flat portions formed between the mountain portions outside of the valley portion so as to be higher than the bottom the valley portion and lower than or equal to the top surface of the mountain portion and satisfies the following relations:

$$0.85 \leqq Sm/D \leqq 3.0$$

$$Sm - D < 450\ (\mu m)$$

$$30 \leqq do \leqq 500\ (\mu m)$$

$$20 \leqq \eta \leqq 95\ (\%),$$

wherein Sm is a mean center distance between the adjoining mountain portions, D is a mean diameter in the outer periphery of the valley portion, do is a mean diameter in the flat top surface of the mountain portion, and $\eta$ is a ratio of a sum of areas in the flat top surface of the mountain portion and areas in the flat surface of the middle flat portion to a whole area of the steel sheet.

According to a second aspect of the invention, there is the provision of a method of producing steel sheets for painting, which comprises subjecting a surface of a work roll for temper rolling to a dulling of surface pattern comprised of a combination of fine crater-like concave portions and ring-like convex portions upheaving at the outer peripheral edge of the concave portion and having a ratio of mean center distance (Sm) between adjoining convex portions to diameter (D) in the outer peripheral edge of the concave portion of 0.85–3.0 and a difference between Sm and D of less than 450 μm through a high density energy source, and then temper rolling a steel sheet with a pair of work rolls, at least one of which being the above dulled work roll, at a draft (λ) of not less than 0.3% to transfer the pattern of the dulled work roll to the surface of the steel sheet.

As the high density energy source, laser is optimum, but plasma and electron beam may be used.

As the steel sheet to be dulled in the temper rolling, cold rolled steel sheets are usually used, but surface-treated steel sheets, which are previously subjected to zinc hot dipping or electroplating, as well as hot rolled steel sheets may be naturally used.

BRIEF DESCRIPTION OF THE DRAWINGS

The invention will be described with reference to the accompanying drawings, wherein:

FIGS. 4 and 5 are graphs showing a relation between center-line average roughness Ra of steel sheet temper rolled with a work roll dulled through the shot blast process and DOI value after painting, wherein FIG. 4 shows results of two-layer coating and FIG. 5 shows results of three-layer coating;

DESCRIPTION OF THE PREFERRED EMBODIMENTS

The invention will be described in detail below.

[1] Dulling of work roll through laser

A work roll for temper rolling is dulled through a high density energy source, e.g. a laser as follows.

Figure 6:
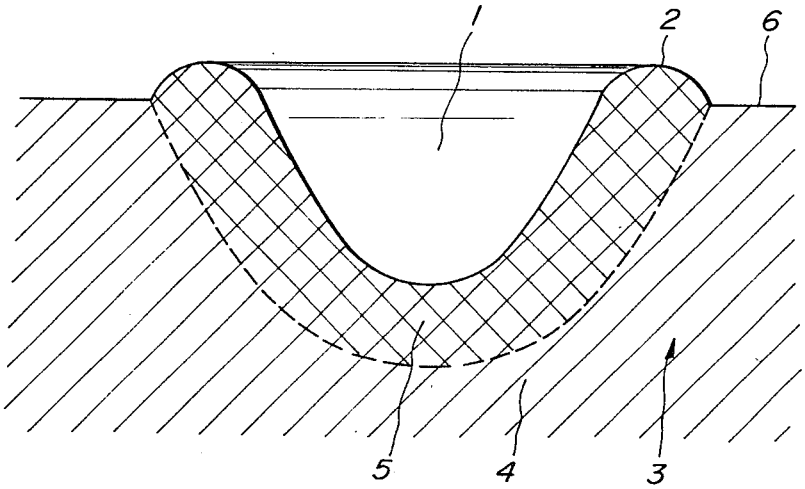
FIG. 6 is a diagrammatically section view partially showing the dulled state of work roll through laser pulse as a high density energy source according to the invention.

A laser pulse is projected onto the surface of the rotating work roll in sequence to regularly fuse surface portions of the roll exposed to a laser energy, whereby crater-like concave portions are regularly formed on the roll surface. FIG. 6 sectionally shows a part of the dulled roll surface, wherein numeral 1 is a crater-like concave portion (hereinafter referred to as a crater simply) formed on a surface of a work roll 3. The fused base metal of the roll upheaves upward from the surface level 6 of the roll 3 in the form of ring around the crater 1 to form a flange-like upheaved portion 2 (hereinafter referred to as a flange simply). Moreover, the inner wall layer of the crater 1 inclusive of the flange 2 is a heat-affected zone to a base metal structure 4 of the roll.

Then, the dulling through laser as described above will be explained in detail.

The depth and diameter of the crater 1 formed on the roll surface through laser pulse are determined by the intensity of energy in the incident laser and the projecting time, which gives a quantity defining a roughness corresponding to surface roughness Ra in the work roll dulled through the conventional shot blast process.

The base metal of the roll heated by laser instantly changes into a metallic vapor due to large energy density of irradiated laser. In this case, the fused metal is blown away from the roll surface by the generated vapor pressure to form the crater 1, while the blown fused metal again adheres to the circumference of the crater 1 to form the flange 2 surrounding the crater 1. Such a series of actions are more efficiently performed by blowing an auxiliary gas such as oxygen gas or the like to the reaction point.

Figure 7:
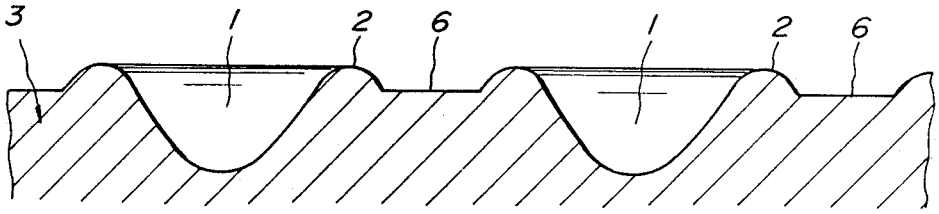
FIG. 7 is a schematically sectional view showing a surface roughness profile of the work roll dulled through the laser pulse.
Figure 8:
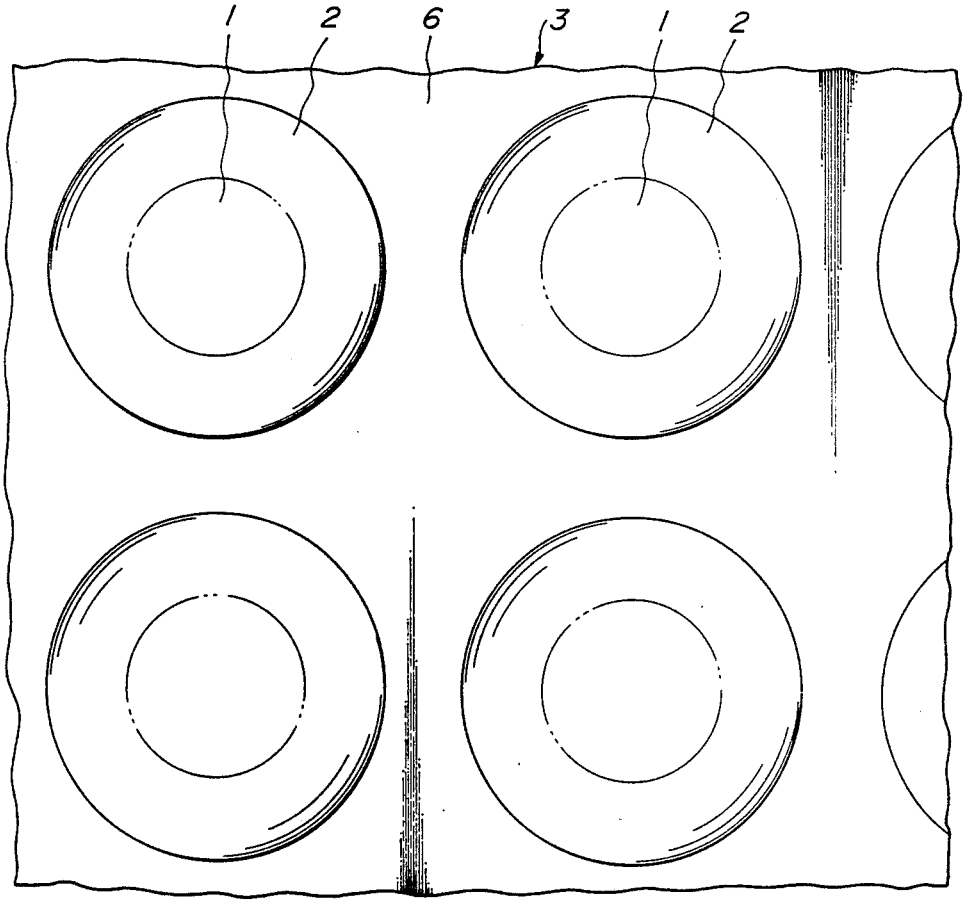
FIG. 8 is a plan view of FIG. 7.

The above craters 1 are regularly formed by regularly irradiating the laser pulse while rotating or axially moving the work roll, whereby the surface of the roll is rendered into a rough state through the gathering of these formed craters. The rough state of the roll surface is shown in FIGS. 7 and 8. As seen from FIGS. 7 and 8, a portion located between the adjacent craters 1 outside the flange 2 is a flat surface 6 corresponding to the original roll surface. Moreover, the mutual distance between the adjacent craters can be adjusted by controlling the frequency of laser pulse in relation to the rotating speed of the roll in the rotating direction of the roll and by controlling the pitch of moving the irradiation position of the laser in the axial direction of the roll.

Although the invention has been described with respect to the use of laser as a high density energy source, similar results are obtained when using a plasma or an electron beam as a high density energy source.

[2] Transfer of dull pattern to steel sheet through temper rolling

A steel sheet such as a cold rolled steel sheet after annealing or the like is rolled at a light draft at the temper rolling step using the work roll dulled through laser as mentioned above, whereby the dull pattern formed on the surface of the work roll is transferred to the surface of the steel sheet to thereby give a rough surface to the steel sheet.

Figure 9:
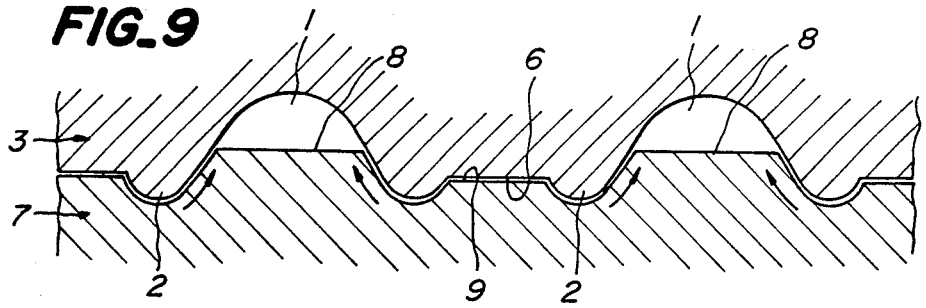
FIG. 9 is a diagrammatically section view showing a state of subjecting the steel sheet to a temper rolling with the work roll shown in FIGS. 6–8.
Figure 10:
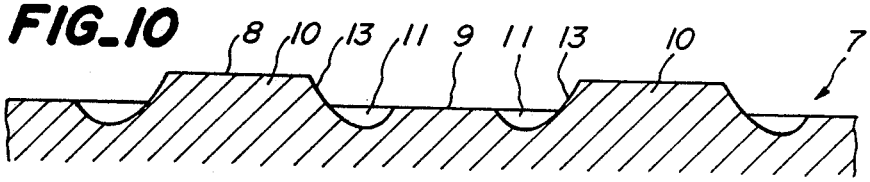
FIG. 10 is a schematically sectional view showing a surface roughness profile of the steel sheet after the temper rolling of FIG. 9.
Figure 11:
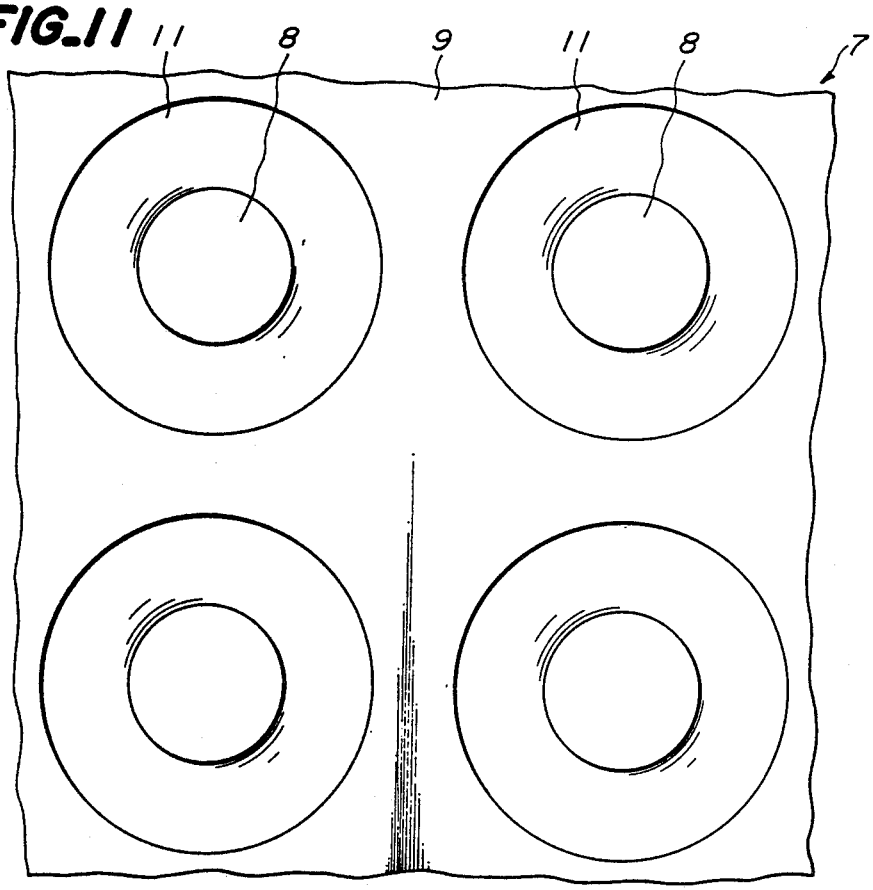
FIG. 11 is a plan view of FIG. 10.

When microscopically observing the steel sheet surface at the temper rolling step, as shown in FIG. 9, the flanges 2 having substantially a uniform height around the crater 1 on the surface of the roll 3 is pushed to the surface of the steel sheet 7 under a strong pressure, whereby the local plastic flow of material is caused near the surface of the steel sheet 7 softer than the material of the roll 3 and consequently metal of the steel sheet 7 flows into the craters 1 of the roll 3 to render the steel sheet surface into a rough state. In this case, a top surface 8 of the upheaved steel sheet inside the crater 1 becomes flat likewise the original steel sheet surface, while that portion 9 of the steel sheet which is pushed by the flat portion 6 between the adjacent craters 1 outside the flange 2 in the roll 3 is flat as it is, and the former flat surface 8 is higher than or equal to the latter flat surface 9. Therefore, as shown in FIGS. 10 and 11, the microscopic shape of surface roughness in the steel sheet 7 after the temper rolling is comprised of trapezoidal mountain portions 10 having a flat top surface 8, groove-like valley portions 11 formed so as to surround the mountain portions, and middle flat portions 9 formed between the adjoining mountain portions 10 outside the valley portion 11 so as to be higher than the bottom of the valley portion 11 and lower than or equal to the top surface of the mountain portion 10.

As seen from the above, the ratio of flat portions comprising the top surface 8 of the mountain portion 10 and the middle flat portion 9 becomes larger in the surface of steel sheet after the temper rolling, while the ratio of slope 13 between the mountain portion 10 and the valley portion 11 becomes principally small.

Figure 12A:
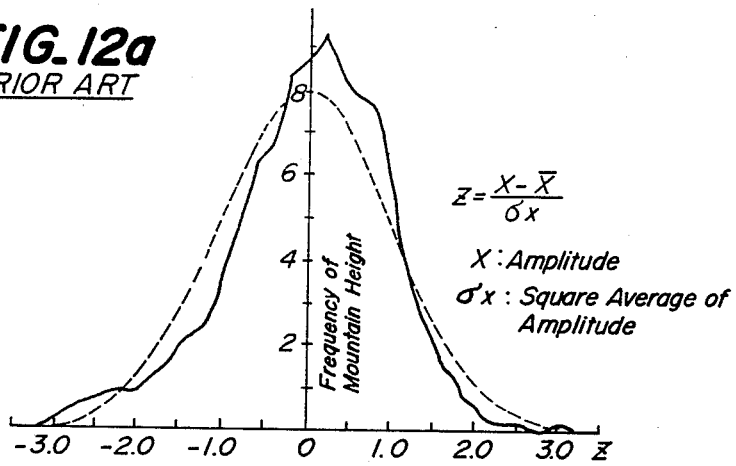
FIG. 12a PRIOR ART
FIG. 12*a* is a graph showing a distribution of mountain height in the surface of the work roll dulled through the conventional shot blast process.
Figure 12B:
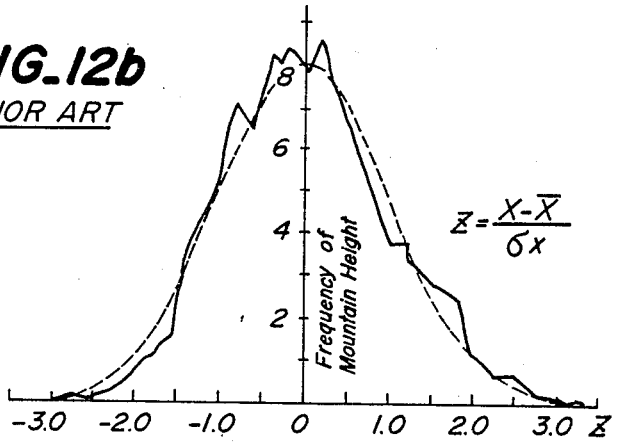
FIG. 12b PRIOR ART
FIG. 12*b* is a graph showing a distribution of mountain height in the surface of the work roll dulled through the conventional discharge working process.
Figure 13:
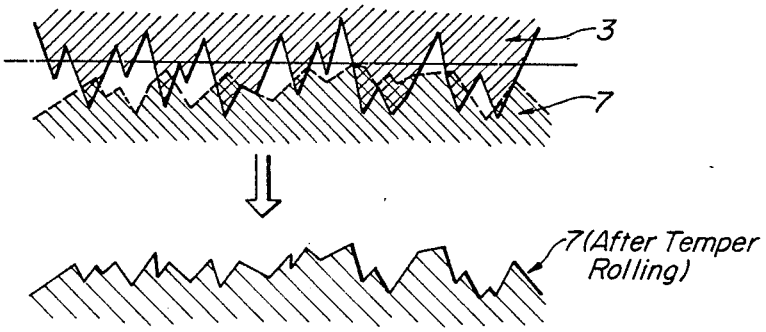
FIG. 13 PRIOR ART
FIG. 13 is a schematic view illustrating a state that the steel sheet is dulled by temper rolling with the work roll dulled through the conventional process.

On the other hand, in case of the work roll dulled through the shot blast process or the discharge working process, the roughness of the roll surface has various mountain heights similar to normal distribution as shown in FIG. 12*a* or 12*b*. In this case, the surface roughness profile of the roll 3 is synthesized with the surface roughness profile of the original steel sheet 7 by the encroach of mountains in the roll 3 on the surface of the steel sheet 7 as shown in FIG. 13, so that the ratio of slopes between the mountain and the valley becomes principally larger in the steel sheet 7 after the temper rolling. Therefore, the structure and formation step of surface roughness profile by the conventional technique are entirely different from those in the steel sheet temper rolled with the work roll dulled through the laser process.

Figure 14A:
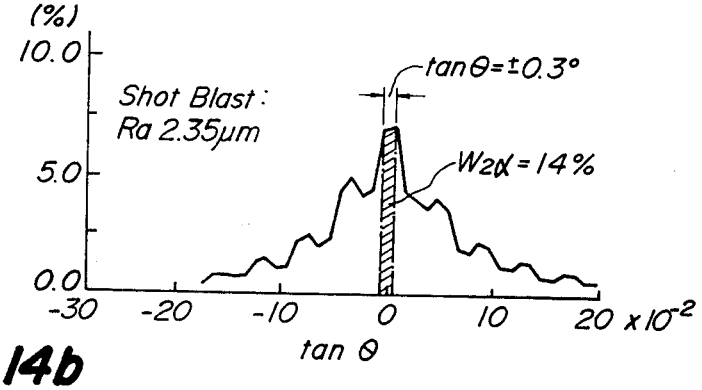
FIG 14a PRIOR ART
FIG. 14*a* is a graph showing an inclination angle distribution in the surface roughness of the steel sheet temper rolled with the work roll dulled through the conventional shot blast process.
Figure 14B:
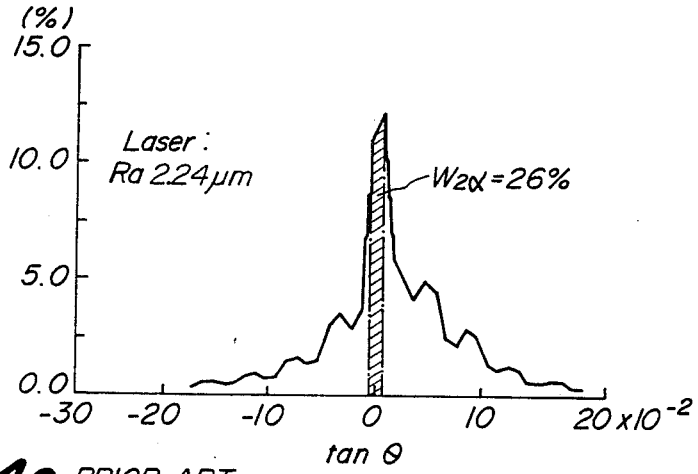
FIG. 14*b* is a graph showing an inclination angle distribution in the surface roughness of the steel sheet temper rolled with the work roll dulled through the laser process.
Figure 14C:
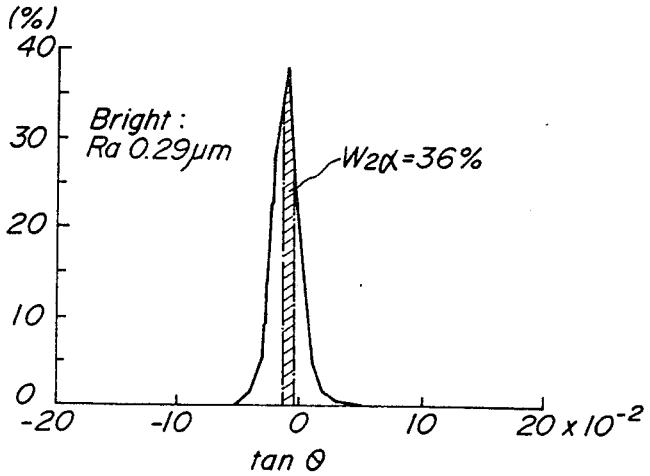
FIG 14c PRIOR ART
FIG. 14*c* is a graph showing an inclination angle distribution of the steel sheet temper rolled with so-called bright work roll not dulled after polishing.
Figure 15:
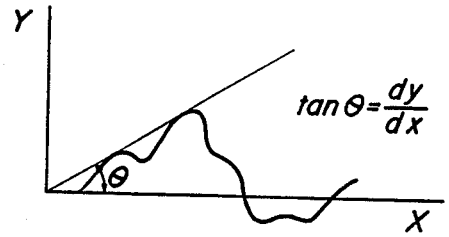
FIG. 15 is a schematic view showing the definition of inclination angle in FIG. 14*a;*

In FIG. 14*a* is shown an inclination angle distribution of surface roughness in the steel sheet after the temper rolling using the work roll dulled through the conventional shot blast process. The definition of the inclination angle ($\theta$) is illustrated in FIG. 15. Since the DOI value indicating the distinctness of image is represented by a ratio of the scattered light at a reflective angle of $30° \pm 0.3°$ to the specular reflected light as previously mentioned, the flatness can be judged to be good when the ratio of valley portion having $\theta$ as an inclination angle with tolerance of $\pm 0.3°$ is large. In case of FIG. 14*a*, however, the occupation ratio ($W_{2\alpha}$) of tan $\theta \leqq \pm 0.3°$ is only 14%. On the other hand, when the steel sheet is temper rolled with the work roll dulled through the laser process, the occupation ratio is 26%, which becomes closer to the occupation ratio of 36% in the bright steel sheet when comparing FIG. 14*b* with FIG. 14*c*. Thus, the high flatness can be obtained in the invention.

Figure 16:
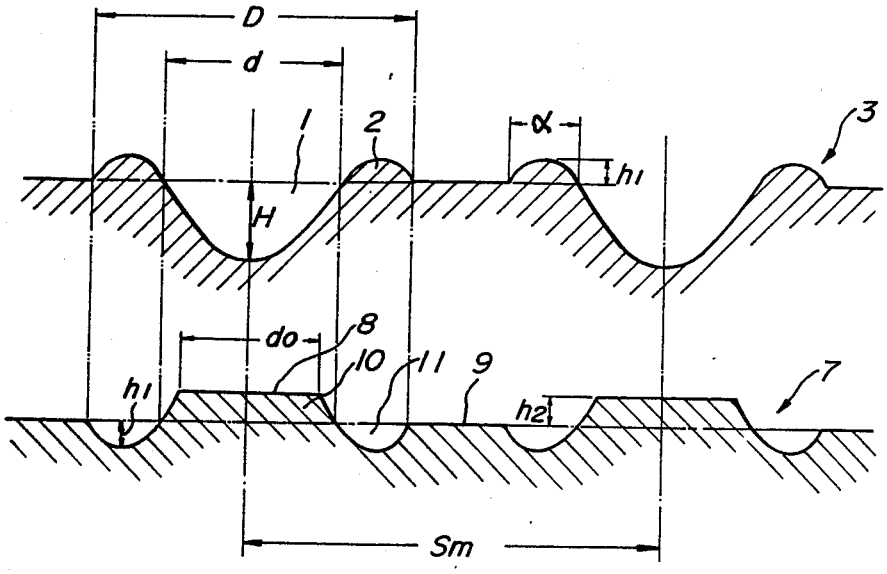
FIG. 16 is a schematic view illustrating the definitions in dimension of each part of profiles constituting rough surfaces of the work roll for temper rolling and the dulled steel sheet.
Figure 17:
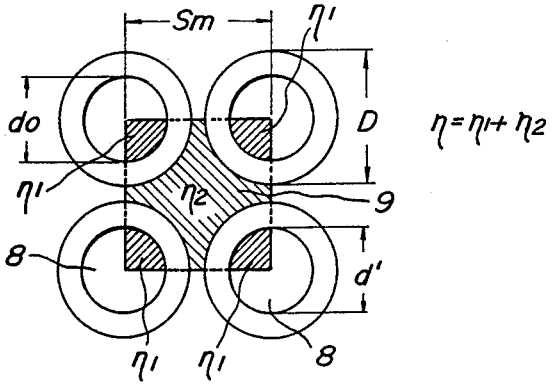
FIG. 17 is a model view showing the definition in area ratio of flat portion $\eta(=\eta_1+\eta_2)$.

[3] Definition of dimension in each part of surface roughness profile of work roll and steel sheet after temper rolling The dimension in each part of surface roughness profile of the work roll dulled through the aforementioned laser process and the steel sheet temper rolled therewith is defined with reference to FIG. 16 as follows:

D: mean outer diameter of flange 2 on roll surface or mean diameter of outer periphery of valley portion 11 on steel sheet surface d: mean diameter of crater 1 on roll surface do: mean diameter of flat top surface 8 of mountain portion 10 on steel sheet surface H: depth of crater 1 on roll surface $h_1$: height of flange 2 on roll surface or depth ranging from middle flat portion 9 to bottom of valley portion 11 on steel sheet surface $h_2$: height ranging from flat top surface 8 to middle flat portion 9 in mountain portion 10 on steel sheet surface Sm: mean center distance between adjoining craters 1 on roll surface or between adjoining mountain portions 10 on steel sheet surface $\alpha$: width of flange 2 on roll surface

[4] Influence on area ratio $\eta$ of flat portions on steel sheet surface after temper rolling The influences of the pattern constituting the surface roughness profile of the roll and the temper rolling conditions upon the area ratio $\eta$ of flat surface portions of the steel sheet after the temper rolling are examined by using the values as previously defined.

The area ratio $\eta$ of flat portions is represented by a sum of area occupation ratio $\theta_1$ of flat top surface 8 of mountain portion 10 and area occupation ratio $\eta_2$ of middle flat portion 9, i.e.

$$\eta = \eta_1 + \eta_2 \tag{1}$$

Moreover, the value of $\eta_1$ varies in accordance with the draft in the temper rolling, because the degree of flowing metal of steel sheet into the crater 1 changes with the change of the draft and hence the diameter do of top surface 8 of mountain portion 10 changes. On the other hand, the value of $\eta_2$ is constant in accordance with the value of Sm/D.

The ratio of Sm/D is within a range defined by the following equation (2) as mentioned later:

$$0.85 \leqq Sm/D \leqq 3.0 \tag{2}$$

Moreover, $\eta_1$ is determined by the following equation (3), and do is constantly related to d as shown in the following equation (4), and $\eta_2$ is determined in accordance with the value of Sm/D by the following equation (5):

$$\eta_1 = \pi\,(do/Sm)^2/4 \tag{3}$$

$$do = kd \tag{4}$$

$$\eta_2 = 1 - \pi\,(D/Sm)^2/4 + a\{(D/Sm)^2 \cos^{-1}(Sm/D) - \sqrt{(D/Sm)^2 - 1}\} \tag{5}$$

In the equation (5), when $Sm/D < 1$, $a = 0$, while when $Sm/D < 1$, $a = 1$. When these data are applied to the equations (2) and (5), $\eta_2$ is within a range defined in the following equation (6):

$$0.06 < \eta_2 < 0.95 \tag{6}$$

Figure 18:
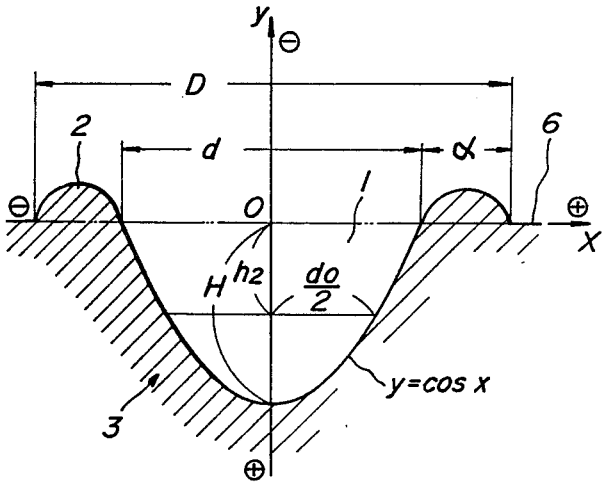
FIG. 18 is a schematic view for approximate calculation of surface roughness profile in the work roll and steel sheet.

As to the sectional shape of surface roughness profile in each of the roll surface and steel sheet surface, when x axis and y axis are taken as shown in FIG. 18, assuming that the sectional shape of crater 1 is $y = \cos x$, the following equations (7) and (8) are established at $d = \pi$ and $\cos do/2 = h_2$.

$$\cos d/2 = 0 \tag{7}$$

$$do = 2\cos^{-1} h_2 \tag{8}$$

Now, a ratio of height $h_2$ of mountain portion 10 transferred onto the steel sheet surface through the crater 1 to depth H of the crater 1 can be called as a roughness transfer ratio. In the aforementioned embodiment, the depth H of crater 1 is 1, so that the roughness transfer ratio is $h_2/1$ or $h_2$.

Such a roughness transfer ratio $h_2/1$ or the height $h_2$ of mountain portion 10 is related to the draft $\lambda$ in the temper rolling as shown in the following equation:

$$h_2 = f(\lambda) \tag{9}$$

This relation was determined from the following experiment.

An SPCC steel sheet having a roughness Ra of 0.38 $\mu$m and a thickness of 0.32 mm was temper rolled at various drafts $\lambda$ by using a work roll having a diameter of 200 mm and an Hs hardness of 94, which was dulled to Ra of 3.54 μm through the laser process, as a roll for temper rolling. The results are shown in FIG. 19.

Figure 19:
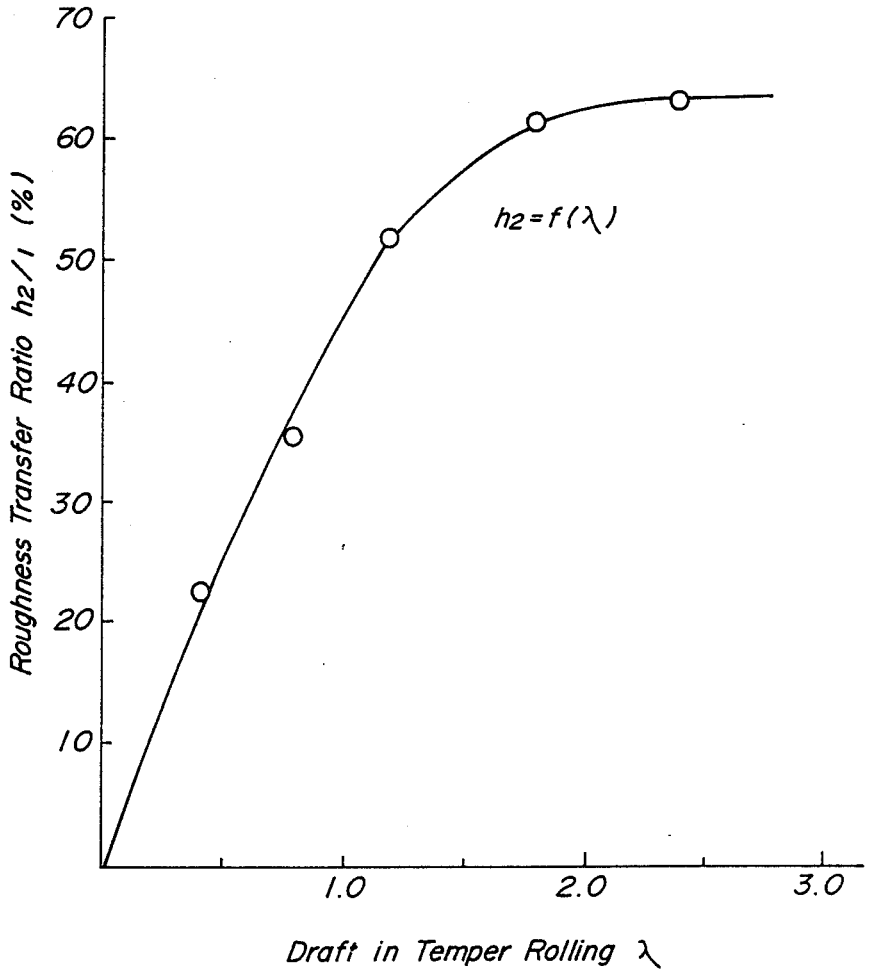
FIG. 19 is a graph showing a relation between a draft λ in the temper rolling and a transfer ratio of roughness $h_2/1$.

As seen from FIG. 19, the roughness transfer ratio $h_2/1$ linearly increases when the draft λ rises up to about 1.5% and is saturated when the draft λ exceeds 1.8%.

The values of do, k and $k^2$ are measured from the results of FIG. 19 to obtain results as shown in the following Table 1.

TABLE 1

| λ | $h_2$ | $d_0 = 2\cos^{-1} h_2$ | $k = d_0/d(=2/\pi\cos^{-1} h_2)$ | $k^2$ |
|---|---|---|---|---|
| 0 | 0 | 3.14 | 1 | 1 |
| 0.4 | 0.226 | 2.69 | 0.86 | 0.74 |
| 0.8 | 0.356 | 2.41 | 0.77 | 0.59 |
| 1.2 | 0.520 | 2.05 | 0.65 | 0.42 |
| 1.8 | 0.616 | 1.81 | 0.58 | 0.34 |
| 2.4 | 0.636 | 1.76 | 0.56 | 0.31 |

When the dulling through laser is performed so as to provide the same average roughness Ra of 1.0–3.0 μm as in the cold rolled steel sheet for usual press forming, the width α of flange between craters is about 0.09×D. Therefore, d is expressed by the following equation(10):

$$d=0.82D \quad (10)$$

When the equation (10) is applied to the equation (4), $$d_0=0.82\ kD \quad (11),$$

so that the equation (3) is represented as follows:

$$\eta_1 = \pi\,(0.82kD/Sm)^2/4 = 0.5281k^2\,(D/Sm)^2 \quad (12)$$

Figure 20:
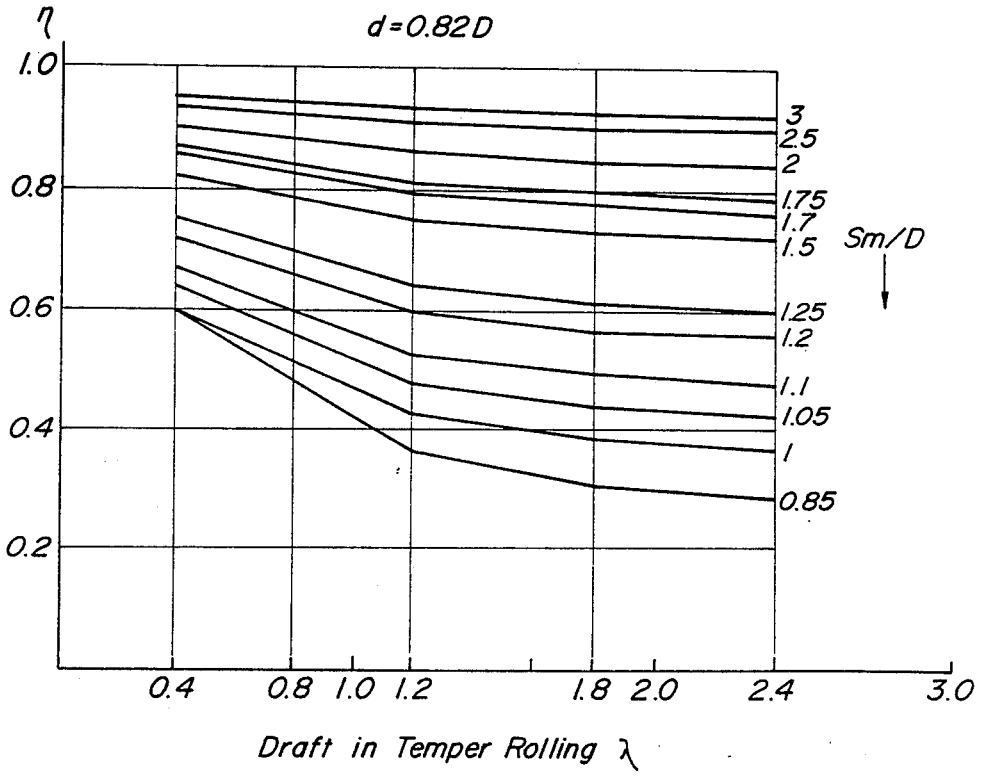
FIG. 20 is a graph showing a relation between the area ratio of flat portion $\eta$ at the steel sheet surface and the draft λ in the temper rolling in accordance with the value of Sm/D.

From the equations (5), (6) and (12) and results of Table 1, the area ratio η of flat portions is shown in the following Table 2. Such an area ratio η is shown in FIG. 20 in accordance with the value of Sm/D. Further, this relation can be generalized by the following equation (13):

$$\eta = \eta_1 + \eta_2 = 0.5281k^2\,(D/Sm)^2 + 1 - \pi/4\,(D/Sm)^2 + a\{(D/Sm)^2\cos^{-1}(Sm/D) - \sqrt{(D/Sm)^2 - 1}\} \quad (13)$$

It is obvious from FIG. 20 that the are ratio of flat portions largely changes in accordance with the ratio of Sm/D. And also, η changes in accordance with the draft λ in temper rolling. Particularly, η is largely influenced by the change of λ when Sm/D is small.

TABLE 2

| Sm/D | $(D/Sm)^2$ | $\eta_2$ | $\eta_1$ λ | $\eta_1$ $k^2$ | $\eta_1$ $\eta_1$ | $\eta = \eta_1 + \eta_2$ |
|---|---|---|---|---|---|---|
| 3 | 1/9 | 0.91 | 0.4 | 0.74 | 0.043 | 0.953 |
| | | | 0.8 | 0.59 | 0.035 | 0.945 |
| | | | 1.2 | 0.42 | 0.025 | 0.935 |
| | | | 1.8 | 0.34 | 0.02 | 0.930 |
| | | | 2.4 | 0.31 | 0.018 | 0.928 |
| 2.5 | 0.16 | 0.87 | 0.4 | 0.74 | 0.06 | 0.93 |
| | | | 0.8 | 0.59 | 0.05 | 0.92 |
| | | | 1.2 | 0 42 | 0.04 | 0.91 |
| | | | 1.8 | 0.34 | 0.03 | 0.90 |
| | | | 2.4 | 0.31 | 0.03 | 0.90 |
| 2 | 1/4 | 0.80 | 0.4 | 0.74 | 0.10 | 0.90 |
| | | | 0.8 | 0.59 | 0.08 | 0.88 |
| | | | 1.2 | 0.42 | 0.06 | 0.86 |
| | | | 1.8 | 0.34 | 0.045 | 0.845 |

TABLE 2-continued

| Sm/D | $(D/Sm)^2$ | $\eta_2$ | $\eta_1$ λ | $\eta_1$ $k^2$ | $\eta_1$ $\eta_1$ | $\eta = \eta_1 + \eta_2$ |
|---|---|---|---|---|---|---|
| | | | 2.4 | 0.31 | 0.04 | 0.840 |
| 1.75 | 0.32 | 0.74 | 0.4 | 0.74 | 0.13 | 0.87 |
| | | | 0.8 | 0.59 | 0.10 | 0.84 |
| | | | 1.2 | 0.42 | 0.07 | 0.81 |
| | | | 1.8 | 0.34 | 0.06 | 0.80 |
| | | | 2.4 | 0.31 | 0.05 | 0.79 |
| 1.5 | 0.444 | 0.65 | 0.4 | 0.74 | 0.17 | 0.82 |
| | | | 0.8 | 0.59 | 0.14 | 0.79 |
| | | | 1.2 | 0.42 | 0.10 | 0.75 |
| | | | 1.8 | 0.34 | 0.08 | 0.73 |
| | | | 2.4 | 0.31 | 0.07 | 0.72 |
| 1.28 | 0.610 | 0.5206 | 0.4 | 0.74 | 0.24 | 0.76 |
| | | | 0.8 | 0.59 | 0.19 | 0.71 |
| | | | 1.2 | 0.42 | 0.14 | 0.66 |
| | | | 1.8 | 0.34 | 0.11 | 0.63 |
| | | | 2.4 | 0.31 | 0.10 | 0.62 |
| 1.25 | 0.64 | 0.50 | 0.4 | 0.74 | 0.25 | 0.75 |
| | | | 0.8 | 0.59 | 0.20 | 0.70 |
| | | | 1.2 | 0.42 | 0.14 | 0.64 |
| | | | 1.8 | 0.34 | 0.11 | 0.61 |
| | | | 2.4 | 0.31 | 0.10 | 0.60 |
| 1.2 | 0.69 | 0.45 | 0.4 | 0.74 | 0.27 | 0.72 |
| | | | 0.8 | 0.59 | 0.21 | 0.66 |
| | | | 1.2 | 0.42 | 0.15 | 0.60 |
| | | | 1.8 | 0.34 | 0.12 | 0.57 |
| | | | 2.4 | 0.31 | 0.11 | 0.56 |
| 1.1 | 0.82 | 0.35 | 0.4 | 0.74 | 0.32 | 0.67 |
| | | | 0.8 | 0.59 | 0.25 | 0.60 |
| | | | 1.2 | 0.42 | 0.18 | 0.53 |
| | | | 1.8 | 0.34 | 0.15 | 0.50 |
| | | | 2.4 | 0.31 | 0.13 | 0.48 |
| 1.05 | 0.91 | 0.28 | 0.4 | 0.74 | 0.36 | 0.64 |
| | | | 0.8 | 0.59 | 0.28 | 0.56 |
| | | | 1.2 | 0.42 | 0.20 | 0.48 |
| | | | 1.8 | 0.34 | 0.16 | 0.44 |
| | | | 2.4 | 0.31 | 0.15 | 0.43 |
| 1 | 1 | 0.21 | 0.4 | 0.74 | 0.39 | 0.60 |
| | | | 0.8 | 0.59 | 0.31 | 0.52 |
| | | | 1.2 | 0.42 | 0.22 | 0.43 |
| | | | 1.8 | 0.34 | 0.18 | 0.39 |
| | | | 2.4 | 0.31 | 0.16 | 0.37 |
| 0.85 | 1.384 | 0.06 | 0.4 | 0.74 | 0.54 | 0.60 |
| | | | 0.8 | 0.59 | 0.43 | 0.49 |
| | | | 1.2 | 0.42 | 0.31 | 0.37 |
| | | | 1.8 | 0.34 | 0.25 | 0.31 |
| | | | 2.4 | 0.31 | 0.23 | 0.29 |

[5] Lower limit of draft in temper rolling

As mentioned above, the draft λ in temper rolling influences on η, but when λ is too small, the temper rolling operation itself is unstable and it is difficult to conduct the dulling of the steel sheet surface. The inventor has found that the dulling is possible when the draft in temper rolling is not less than 0.3%. Therefore, the lower limit of the draft λ is 0.3%.

[6] Lower limit of area ratio η of flat portions

In the dulling of the work roll for temper rolling through the laser, Sm, D and d as well as the draft λ were varied to obtain steel sheets having various area ratio η of flat portions (Ra: approximately 1.5 μm). After a black paint was applied to the steel sheet as a three-layer coating, the DOI value on the painted surface was measured to obtain results as shown in FIG. 21.

Figure 21:
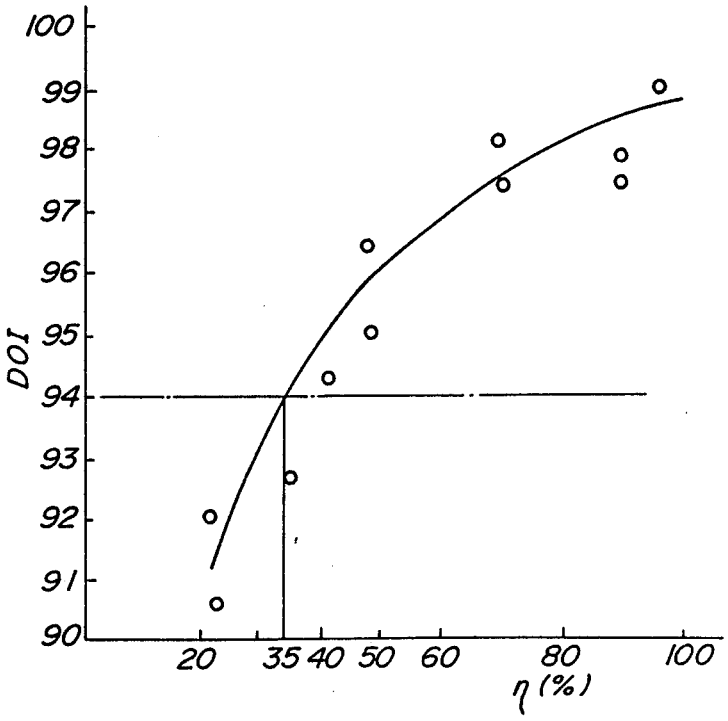
FIG. 21 is a graph showing a relation between the area ratio of flat portion $\eta$ of the steel sheet and a DOI value after painting in case of three-layer coating.

As seen from FIG. 21, the DOI value increases as η becomes large, and hence the distinctness of image becomes good. In general, it is desirable that DOI value is not less than 94% for giving satisfactory high-grade feeling to the coating on the vehicle body. For this purpose, it is desired that η is not less than 35%. When the high-grade feeling is not so required, however, $\eta$ is sufficient to be not less than 20%. Therefore, the lower limit of $\eta$ is 20%.

[7] Upper limits of Sm/D, Sm-D and $\eta$

The dimensions such as D, Sm, H and the like in the surface roughness profile of the roll defined in the above item [3] can be changed by adjusting the dulling conditions of work roll for temper rolling through laser such as revolution number of roll, frequency of laser pulse, output of laser, speed of feeding laser irradiation point and laser irradiation time, or the blowing condition of auxiliary gas such as $O_2$ gas or the like as seen from the above. If it is intended to temper roll the usual formable cold rolled steel sheet with the work roll dulled to Ra of 0.5–5 $\mu$m through the laser, the surface of the work roll has a flange width $\alpha$ of about 20–40 $\mu$m and a flange height $h_1$ of about 5–30 $\mu$m.

Figure 22A:
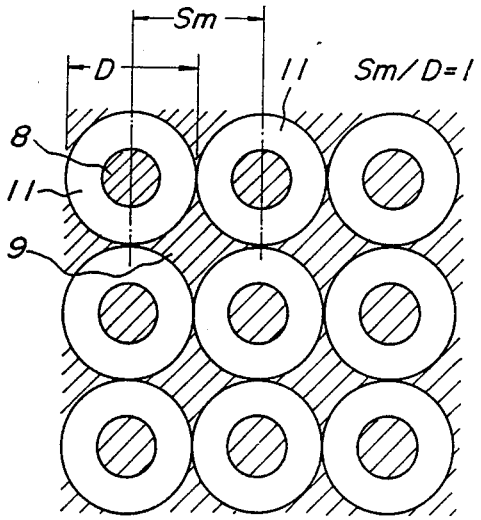
FIGS. 22*a* to 22*c* are schematic views showing a change of roughness profile in the flat surface of the steel sheet when varying Sm/D.
Figure 22B:
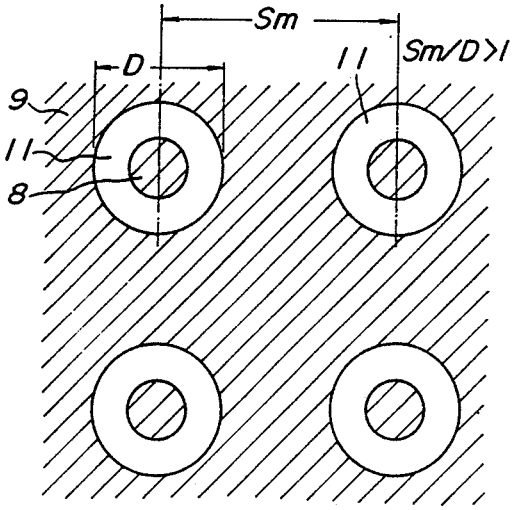
Figure 22C:
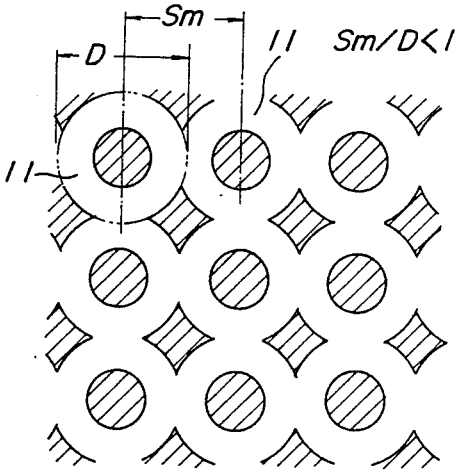

In the surface roughness profile formed on the steel sheet, three patterns as shown in FIGS. 22*a* to 22*c* are obtained in accordance with the value of Sm/D. That is, when Sm/D is 1, the adjoining valley portions 11 just come into contact with each other as shown in FIG. 22*a*. When Sm/D > 1, the adjoining valley portions 11 separate away from each other as shown in FIG. 22*b*. Further, when Sm/D < 1, the adjoining valley portions 11 overlap with each other as shown in FIG. 22*c*.

Thus, various patterns of the surface roughness profile can be obtained by changing the value of Sm/D. In this connection, work rolls for temper rolling having various values of Sm/D were prepared through the laser process, and then the formation of dull pattern on the cold rolled steel sheet after annealing was performed by temper rolling at a proper drat with these work rolls. Thereafter, the dulled steel sheet was subjected to a press forming test and a painting test, from which the following knowledges were obtained.

Figure 23:
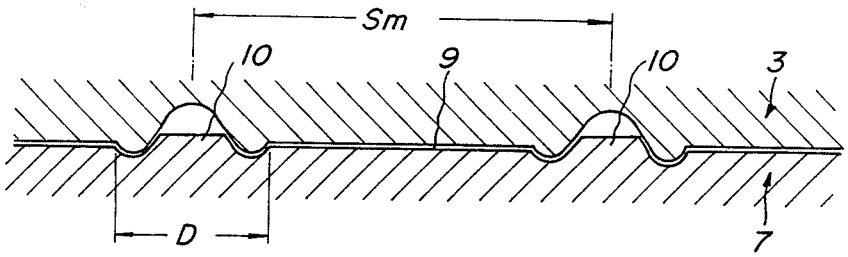
FIG. 23 is a diagrammatically section view of a microscopic profile at the surfaces of work roll and steel sheet when the ratio of Sm/D is excessive.
Figure 24:
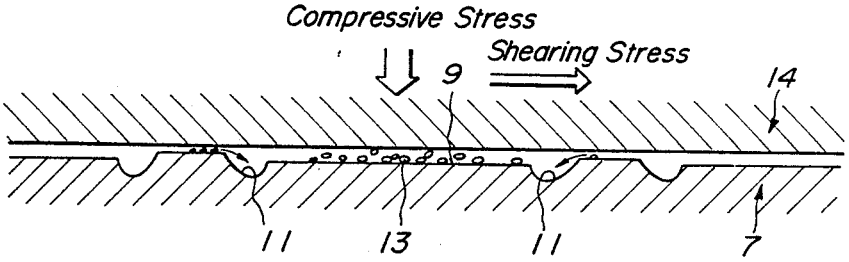
FIG. 24 is a schematic view when the steel sheet of FIG. 23 is subjected to a press forming.

Namely, when the steel sheet 7 is temper rolled with the work roll 3 as shown in FIG. 23, as the value of Sm/D in the roll becomes considerably large, the area of the middle flat portion 9 existent between the adjoining mountain portions 10 on the steel sheet surface is excessive. As a result, when such a steel sheet is subjected to a press forming as shown in FIG. 24, metallic debris 13 exfoliated at the wider middle flat portion 9 during the press forming are difficult to be trapped by the valley portion 11 and remain between press tool 14 and middle flat portion 9. Furthermore, the feature that Sm/D is considerably large means that the space of the valley portion 11 acting to reserve a lubricating oil becomes relatively small and is apt to cause poor lubrication. Therefore, when Sm/D is too large, the galling is liable to be caused in the press forming.

Moreover, it is required to control the width of middle flat portion 9 or absolute value of Sm-D from the following reason.

The size of the flange formed on the roll surface through the laser process, i.e. width $\alpha$ and height $h_1$ are related to a course that a part of metal in the crater portion fused by laser upheaves at its circumference and is resolidified. When D is large, $\alpha$ and $h_1$ also become large. That is, when D is large, a capacity of reserving a lubricating oil in the press forming and a capacity of trapping exfoliated metallic debris become large, which is significant for preventing the galling. However, the effectiveness is restricted to such a case that concave portion such as groove or the like capable of trapping exfoliated metallic debris is existent on the surface of the material to be worked in such a relative sliding length between the press mold and the material that the exfoliated metallic debris gradually deposit and finally cause the galling. In order to satisfy this requirement, it is necessary that the absolute value of width of middle flat portion (Sm−D) is made smaller than a certain value.

Figure 26:
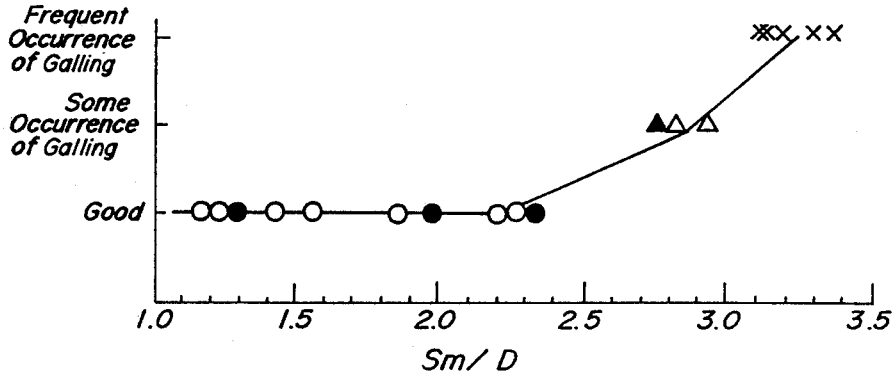
FIG. 26 is a graph showing the galling limit in the similar test varying Sm/D.

The inventor has found from the aforementioned experiments that in case of steel sheets having not a very high formability, which are used as an outer panel for automobile requiring particularly a high distinctness of image, since the strain ratio in the press forming is within 10%, unless the value of Sm/D exceeds 3.0, the galling is not frequently caused in the press forming as shown in FIG. 26 (○, Δ and x).

As previously mentioned, the flanges are formed on the roll surface around the craters by blowing the auxiliary gas to upheave metal fused by laser onto the roll surface. In this case, the flange does not necessarily take a circle due to slight ununiformity of auxiliary gas flowing distribution and fluctuation of flowing rate, i.e. a part of the flange is cut off. Therefore, in the surface of the steel sheet temper rolled by the work roll having the above flanges of irregular form, a part of the mountain portion is not surrounded by the valley portion, which results in the increase of $\eta$ to improve the distinctness of image. The same experiment as described above was made with respect to such a steel sheet to obtain results (●, ▲ and #) as shown in FIG. 26, there is no great difference in the press formability between the case that the mountain portion is completely surrounded by the valley portion and the case that the mountain portion is partially surrounded by the valley portion.

Figure 25:
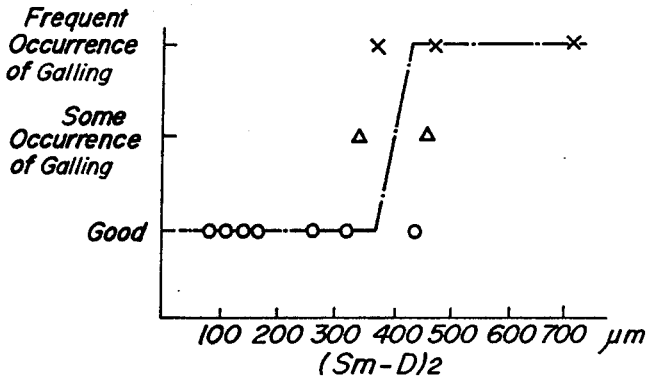
FIG. 25 is a graph showing the galling limit in the press forming test varying $(Sm-D)_2$.
Figure 27:
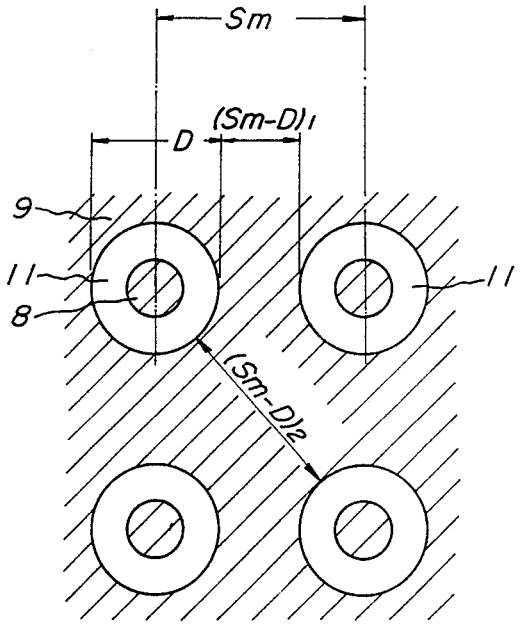
FIG. 27 is a schematic view showing a width of middle flat portion (Sm−D)

Further, it has been found that the absolute value of width of middle flat portion 9 (Sm−D) is required to be made smaller than 450 $\mu$m in order to prevent the frequent occurrence of galling as shown in FIG. 25. The results of these experiments are shown in the following Table 3, wherein the definitions of $(Sm-D)_1$ and $(Sm-D)_2$ are shown in FIG. 27, respectively.

TABLE 3

| Sample No. | Mean D ($\mu$) | Mean Sm ($\mu$) | Sm/D | $\eta$ | $(Sm-D)_1$ ($\mu$) | $(Sm-D)_2$ ($\mu$) | Result of press test |
|---|---|---|---|---|---|---|---|
| A1 | 107 | 152 | 1.42 | 76 | 45 | 108 | good |
| A2 | 105 | 193 | 1.84 | 86 | 88 | 168 | good |
| A3 | 107 | 311 | 2.91 | 95 | 204 | 333 | some galling occurred |
| A4 | 104 | 343 | 3.30 | 96 | 239 | 381 | galling frequently occurred |
| B1 | 153 | 174 | 1.14 | 64 | 21 | 93 | good |
| B2 | 149 | 329 | 2.20 | 90 | 180 | 316 | good |
| B3 | 157 | 439 | 2.80 | 93 | 282 | 464 | some galling |

TABLE 3-continued

| Sample No. | Mean D (μ) | Mean Sm (μ) | Sm/D | η | $(Sm-D)_1$ (μ) | $(Sm-D)_2$ (μ) | Result of press test |
|---|---|---|---|---|---|---|---|
| B4 | 151 | 506 | 3.35 | 96 | 355 | 565 | occurred galling frequently occurred |
| C1 | 212 | 254 | 1.20 | 66 | 42 | 147 | good |
| C2 | 221 | 340 | 1.54 | 80 | 119 | 260 | good |
| C3 | 206 | 454 | 2.20 | 90 | 248 | 436 | good |
| C4 | 203 | 641 | 3.16 | 95 | 438 | 704 | galling frequently occurred |

As previously mentioned on FIG. 20, the value of Sm/D is interrelated to the area ratio η of flat portions on the steel sheet surface. According to the above experiments, the galling frequently occurs when the area ratio η exceeds 95% as can be seen from Table 3.

According to the invention, therefore, the upper limit of Sm/D is 3.0, the upper limit of area ratio η is 95%, and the upper limit of (Sm−D) is less than 450 μm in order to provide steel sheets causing no galling and having a good press formability.

[8] Lower limit of Sm/D

When the ratio of Sm/D is less than 0.85, the dulling operation of work roll through the high density energy source such as laser or the like is unstable and the control of Ra is difficult. Further, the change of surface roughness in the work roll is conspicuous in the temper rolling operation and the ragging is apt to be caused by exfoliating a part of the roll constituting the rough surface. This is due to the following reason.

Figure 28A:
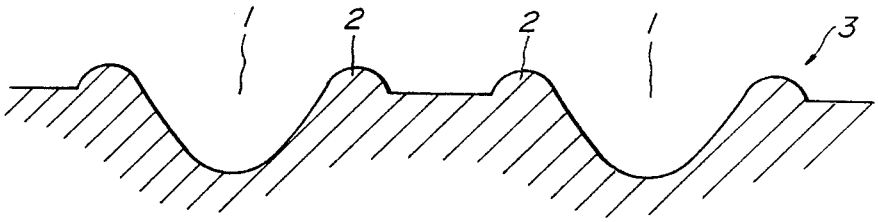
FIGS. 28*a* to 28*c* are schematic views illustrating the state of work roll through laser processing when the ratio of Sm/D is varied around 0.85.
Figure 28B:
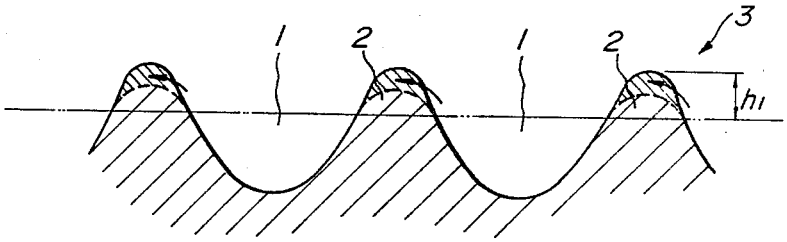

In general, the flange width α is formed within a range of α=0.1–0.3D with respect to the outer diameter D of the flange so as to attain the reserving of the lubricating oil and the trapping of metallic debris exfoliated in the press working. When Sm/D exceeds 1, the adjoining flanges 2 separate away from each other as shown in FIG. 28*a*, while when Sm/D is less than 1, the adjoining flanges 2 overlap with each other. Moreover, when α=0.3D and Sm=0.85D, molten metal generated from the adjoining crater rides on the previously formed flange 2 as shown in FIG. 28*b*, so that the height $h_1$ of the resulting flange 2 is about two times that of the case having no piling of molten metal.

Figure 28C:
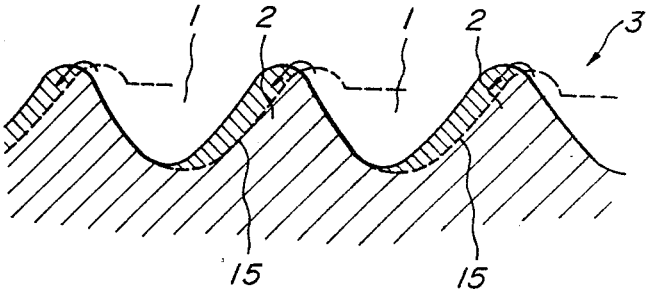

Further, when Sm<0.85D (α=0.3D), molten metal flows into the previously formed crater from the adjoining crater as shown in FIG. 28*c*, whereby the depth H of the crater 1 and the height $h_1$ and width α of the flange are changed. Thus, when molten metal flows onto the previously solidified metal in the crater, a clear boundary 15 is formed between the previously solidified metal layer and the later solidified metal layer, at where both the layers are apt to be separated by external force, which is liable to cause the ragging in the temper rolling.

From the above facts, the lower limit of Sm/D should be 0.85.

[9] Diameter $d_0$ of flat top surface in mountain portion of steel sheet surface The flat top surface 8 of mountain portion 10 constituting the microscopic surface roughness profile of steel sheet is a plane bearing the press load in the press forming, which corresponds to a so-called load bearing area.

As the diameter $d_0$ of the top surface 8 becomes large, the area of this flat top surface becomes large, which tends to cause the galling likewise the case that Sm/D and η are large as previously mentioned on the item [7]. The inventor has found from the experiments that when $d_0$ exceeds 500 μm, the galling is apt to be caused. Further, in order to form a wide top surface 8 having $d_0$ of more than 500 μm, it is necessary that the diameter of the crater 1 in the roll is also made large. For this purpose, the energy quantity required in the laser pulse irradiation for the formation of craters should be excessive, which requires the use of a laser generator having a considerably large output or the prolonging of irradiation time by decreasing the revolution number of the roll. This is not only disadvantageous in economy but also brings about the decrease of total treating efficiency and reliability. Therefore, the upper limit of $d_0$ should be 500 μm.

On the other hand, when the diameter $d_0$ of the top surface 8 in mountain portion 10 is too small, the mountain portion 10 is apt to be broken by compressive stress and shearing stress in the press forming to produce a large amount of metallic debris therefrom, which is also liable to cause the galling. The inventor has confirmed that the galling is apt to be caused when $d_0$ is less than 30 μm. As $d_0$ becomes small, the value of D is necessarily small, so that the value of Sm itself should be small in order to satisfy Sm/D≦3.0 as previously mentioned on the item [7] when $d_0$ is made small. That is, the distance between the craters in the roll should be small. For this purpose, the revolution number of roll is extremely decreased in the laser irradiation or the frequency of laser pulse is considerably increased, which becomes disadvantageous in economy. From these reasons, the diameter $d_0$ of the top surface 8 in mountain portion 10 should be not less than 30 μm.

In the invention, the diameter $d_0$ of the top surface 8 is sufficient within a range of 30–500 μm on average. In fact, when the mountain portions 10 are formed by temper rolling with the work roll dulled through the high density energy source such as laser, the plan from of the flat top surface 8 in the mountain portion 10 is not always true circle and frequently becomes oblong or irregular. In the latter case, therefore, it is desirably adjusted that the mean value of major axis in top surfaces is not more than 500 μm and the mean value of minor axis in top surfaces is not less than 30 μm. Of course, it is most suitable that the maximum major axis in all top surfaces is not more than 500 μm and the minimum minor axis in all top surfaces is not less than 30 μm.

[10] Center-line average surface roughness Ra of steel sheet

According to the invention, it is most important to control the microscopic profile forming the rough surface of steel sheet as previously mentioned, and also it is important to control the surface roughness of steel sheet.

Even when the microscopic profile is controlled as mentioned above, if the center-line average roughness Ra exceeds 3.0 μm, the distinctness of image after painting is not sufficiently good, while if Ra is less than 0.3 μm, the galling is apt to be caused in the press forming. Therefore, Ra should be within a range of 0.3–3.0 μm. Preferably, Ra is not more than 2.0 μm in order to provide a DOI value of not less than 94 as a distinctness of image.

As mentioned above, in order that the steel sheets temper rolled with the work roll dulled through the high density energy source such as laser or the like have a good press formability (or resistance to galling) and an excellent distinctness of image for painting required in automobiles, preferably DOI value of not less than 94, it is necessary that the microscopic surface roughness profile of steel sheet satisfies the following conditions:

(i) a ratio of a sum of areas of flat portions (top surface of mountain portion and middle flat portion) to whole area (area occupation ratio of flat portions, $\eta$) is not less than 20% (preferably not less than 35%) but not more than 95%;

(ii) a ratio (Sm/D) of mean center distance Sm between mountain portions to mean diameter D of outer periphery of valley portion is within a range of 0.85–3.0 and Sm−D is less than 450 μm; and (iii) a mean diameter $d_0$ of top surface of mountain portion is within a range of 30–500 μm. Besides, the center-line average roughness Ra is necessary to be within a range of 0.3–3.0 μm. Moreover, the draft $\lambda$ in temper rolling is required to be not less than 0.3%.

Figure 29:
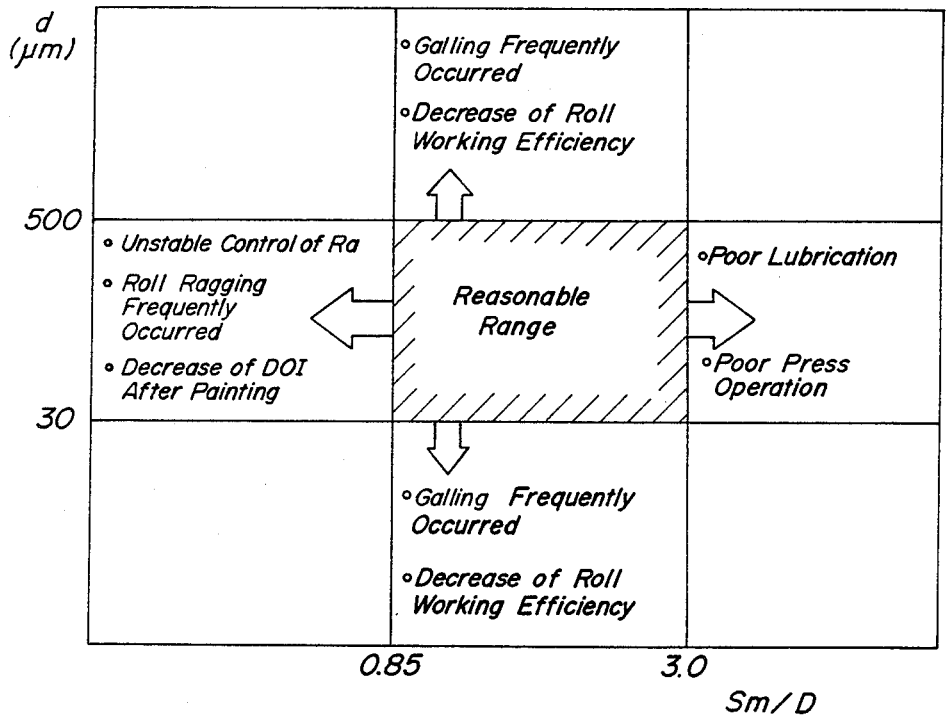
FIG. 29 is a graph showing a relation between the ratio of Sm/D and a diameter of a top surface in mountain portion of the steel sheet surface as a proper region.
Figure 30:
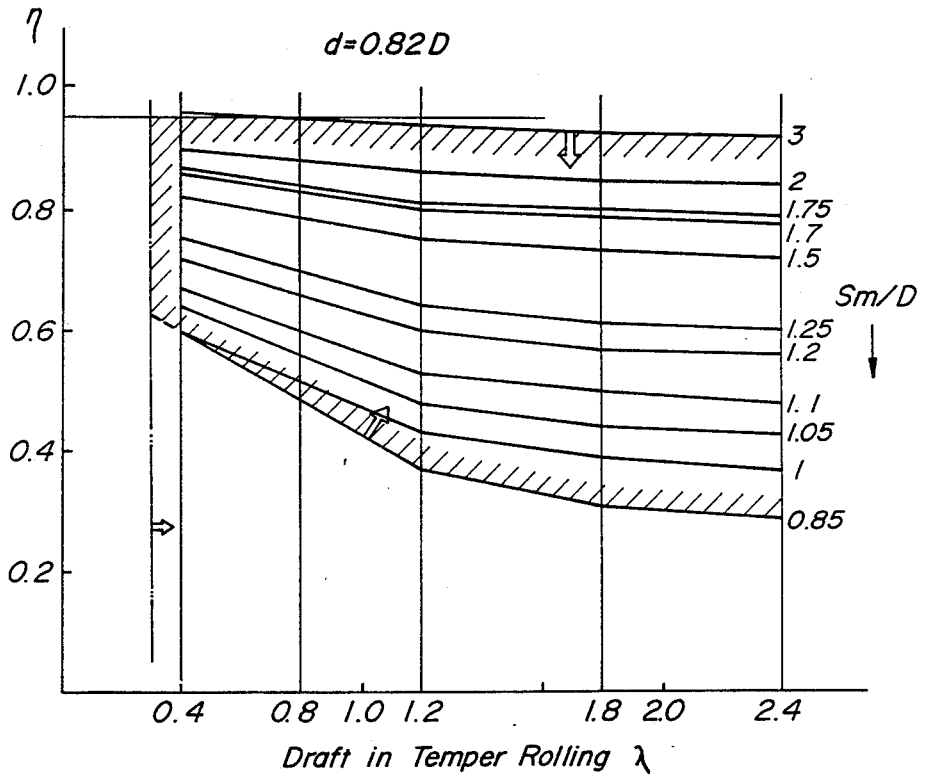
FIG. 30 is a graph showing proper regions of $\lambda$, $\eta$ and Sm/D.

Among the above conditions, a relation between Sm/D and $d_0$ is shown in FIG. 29 together with its reasonable range and limitation reason. Further, the adaptable range of Sm/D for putting $\eta$ into an optimum range (20–95%) when varying the draft $\lambda$ in temper rolling is shown in FIG. 30.

The following example is given in illustration of the invention and is not intended as limitations thereof.

EXAMPLE

As a starting sheet was used a cold rolled steel sheet of 0.8 mm in thickness, which was produced by cold rolling a steel sheet containing C: 0.04%, Mn: 0.2%, P: 0.02%, S: 0.015%, N: 0.003% and O: 0.005% at a draft of 69.2% and annealing in a box annealing furnace.

As a work roll for temper rolling, there were provided a roll dulled through a laser pulse process, a roll dulled through the conventional shot blast process, a roll dulled through the conventional discharge working process, and a bright roll not dulled. Then, the cold rolled steel sheet was temper rolled with this work roll at a draft $\lambda$ ranging from 0.5% to 2.5%.

The surface roughness Ra of the bright roll was 0.15 μm, while the surface roughness Ra of the dulled roll was within a range of 1.1–5.6 μm. As the surface roughness profile of the work roll dulled through the laser pulse process, there were particularly provided sample A with $0.85 \leqq Sm/D \leqq 1.7$, $Sm-D<280$ μm, $50\ \mu m \leqq d \leqq 500\ \mu m$, $35\ \mu m \leqq H \leqq 120\ \mu m$ and $h_1 \simeq 1/3H$, and a sample B with $1.7 \leqq Sm/D \leqq 3.0$, $Sm-D<450$ μm, $50\ \mu m \leqq d \leqq 500\ \mu m$, $35\ \mu m \leqq H \leqq 120\ \mu m$ and $h_1 \simeq \frac{1}{3}H$.

The surface roughness of the temper rolled steel sheet was Ra=0.08 μm in case of using the bright roll and Ra=0.6−2.25 μm in case of using the dulled roll. Particularly, in the steel sheet temper rolled with the work roll dulled through the laser pulse process, the surface roughness profile on sample A had $0.85 \leqq Sm/D \leqq 1.7$, $Sm-D<280$ μm and $30\ \mu m \leqq d \leqq 500\ \mu m$, and that on sample B had $1.7 \leqq Sm/D \leqq 3.0$, $Sm-D<450$ μm and $30\ \mu m < d \leqq 500\ \mu m$.

Then, the temper rolled steel sheet was subjected to a phosphating treatment under the following conditions:

Treating material: granulated phosphate agent for dipping treatment

Dipping conditions: 43° C.×120 seconds

Weight of phosphate layer: 2.3±0.2 g/cm$^2$

Pretreatment: degreasing, washing with water, surface adjustment

Post treatment: washing with water, washing with pure water, drying

After the phosphating treatment, three-layer coating was formed under the following conditions:

Painting posture: horizontal

Undercoat: Cation ED paint, 18–20 μm thickness

Inter coat: sealer, 30–35 μm thickness

Top coat: 30–35 μm thickness

Moreover, the sanding was not performed in each painting step.

After the painting, DOI value of the painted surface was measured by means of a Dorigon meter.

Figure 31:
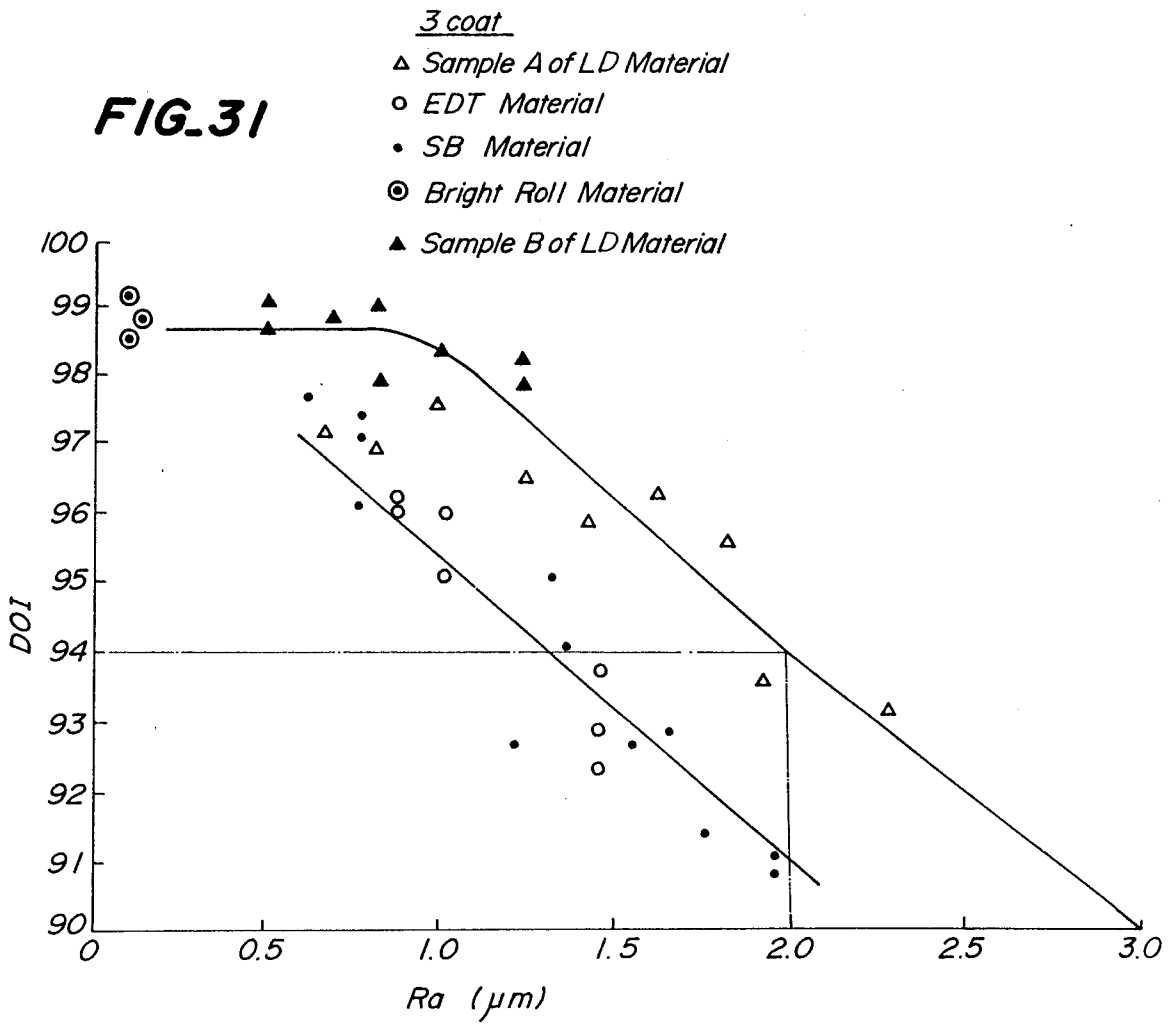
FIG. 31 is a graph showing a relation between the center-line average roughness Ra of the steel sheet and the DOI value after painting in case of three-layer coating.

The measured results are shown in FIG. 31 in connection with the surface roughness Ra of the steel sheet, wherein LD material is a steel sheet temper rolled with the work roll dulled through the laser pulse process, EDT material is a steel sheet temper rolled with the work roll dulled through the discharge working process, SB material is a steel sheet temper rolled with the work roll dulled through the shot blast process, and bright roll material is a steel sheet temper rolled with the so-called bright roll not dulled.

As seen from FIG. 31, the sample A of LD material is excellent by about 10–11 points in the DOI value as a distinctness of image as compared with EDT and SB materials, and the sample B of LD material is further excellent by 1 point in the DOI value and has a DOI value of 98.

Figure 32:
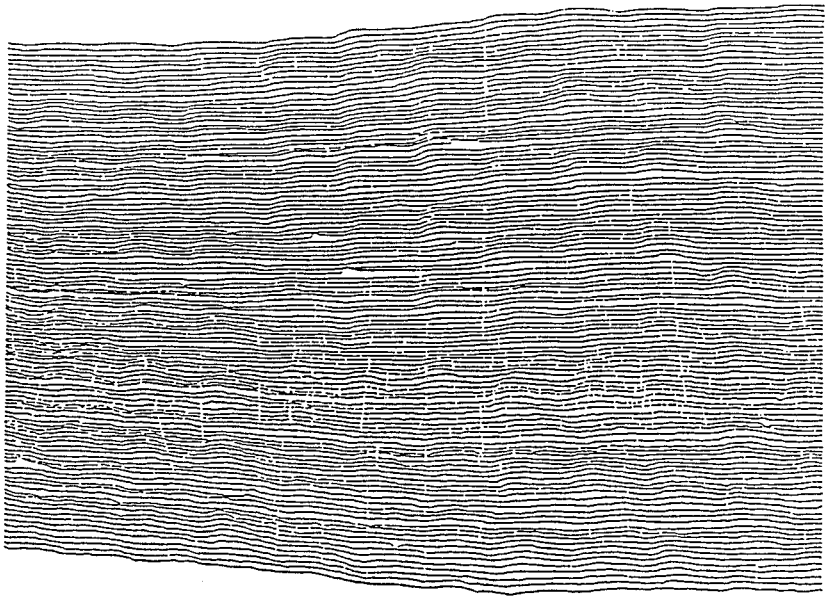
FIG. 32 is a chart showing a three-dimensional roughness of a coating formed on the steel sheet temper rolled with a work roll dulled through laser process.
Figure 33:
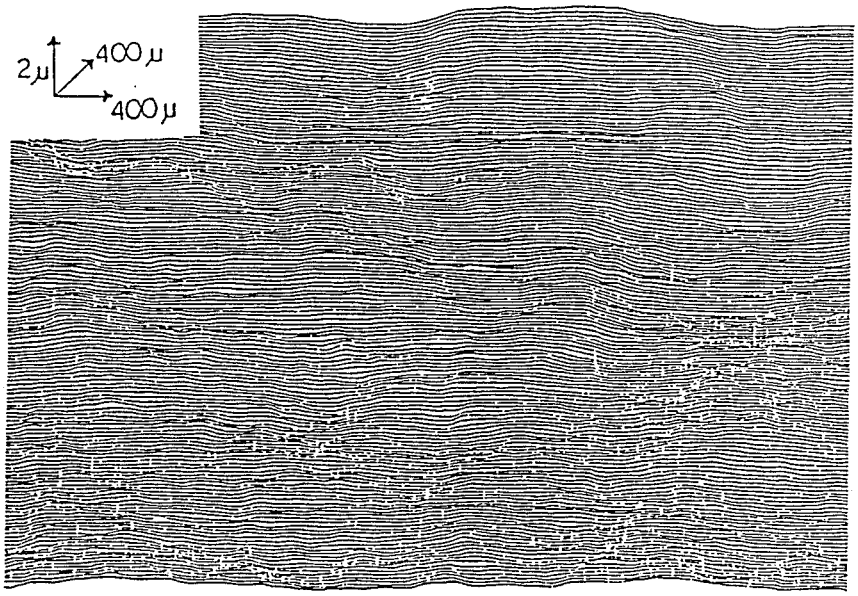
FIG. 33 PRIOR ART
FIG. 33 is a chart showing a three-dimensional roughness of a coating formed on the steel sheet temper rolled with a work roll dulled through the conventional shot blast process.

The roughness of LD material and SB material after painting are shown in FIGS. 32 and 33 as a three-dimensional roughness chart, respectively, from which the LD material (FIG. 32) is considerably smooth in the painted surface as compared with the SB material (FIG. 33).

Figure 34:
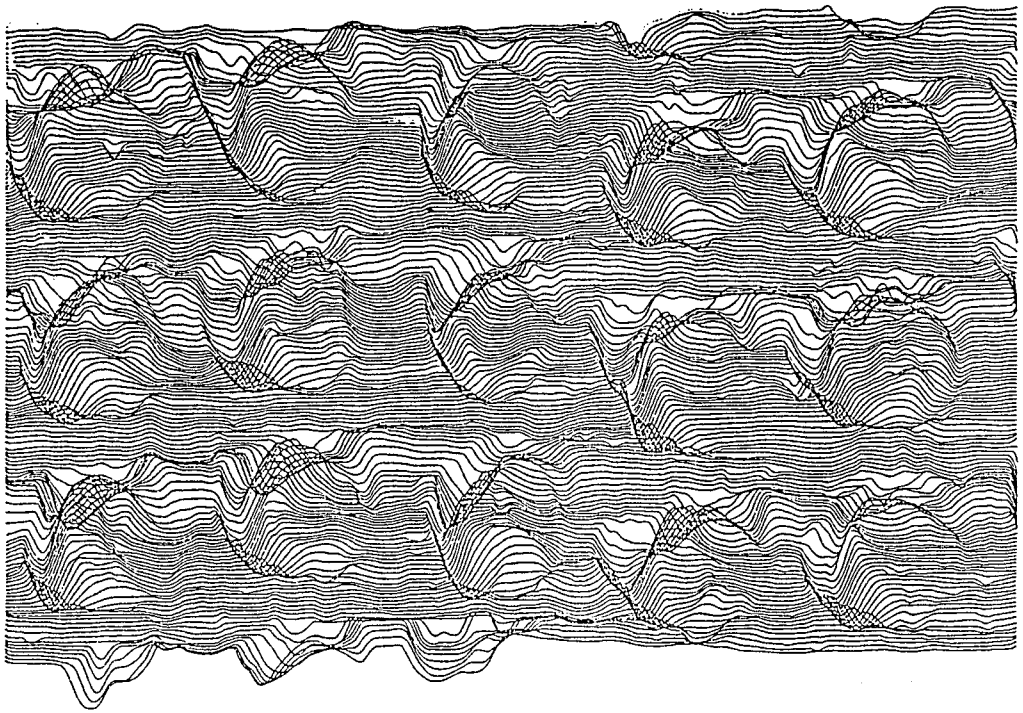
FIG. 34 is a view illustrating a three-dimensional profile of surface roughness in the steel sheet temper rolled with a work roll dulled through laser process.

The three-dimensional surface roughness profile of the LD material before painting is shown in FIG. 34, from which the surface roughness profile is regularly formed in the LD material.

Figure 1:
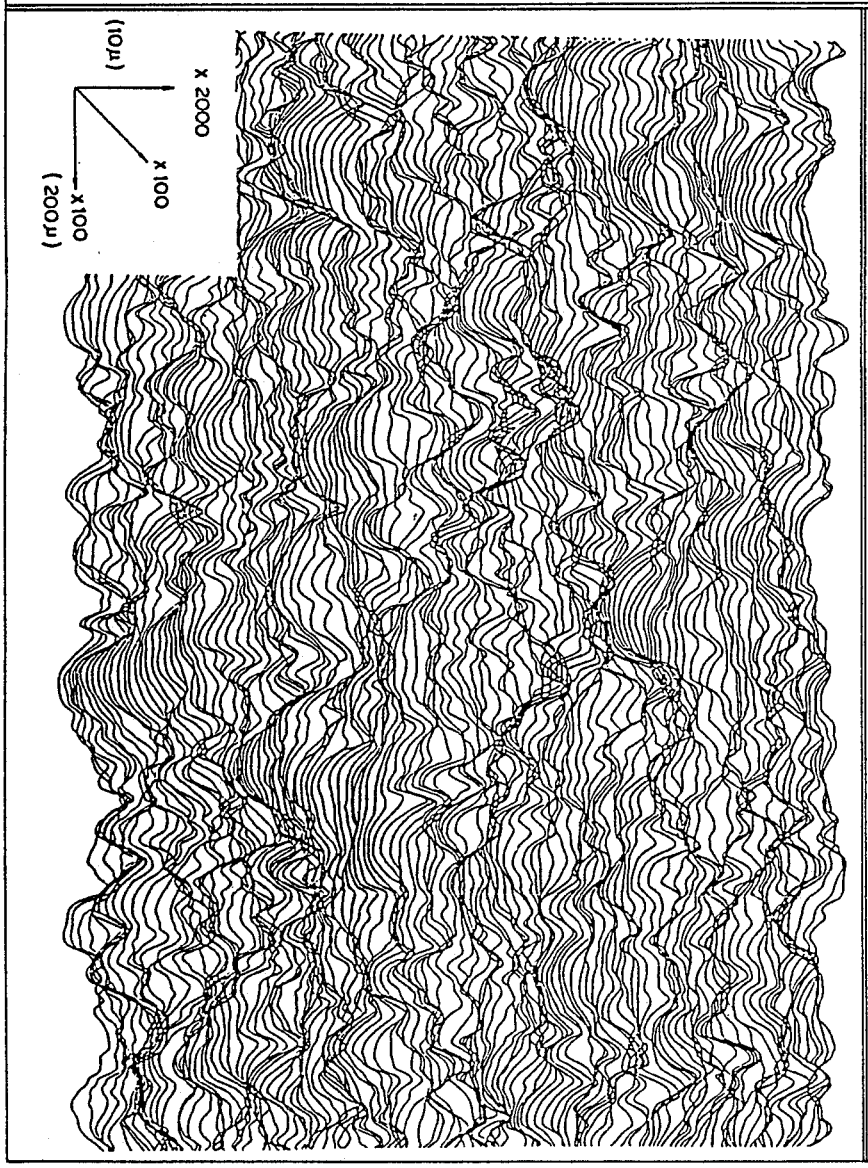
FIG 1 PRIOR ART
FIG. 1 is a view illustrating a three-dimensional profile of surface roughness in a work roll dulled through the conventional discharge working process.
Figure 2:
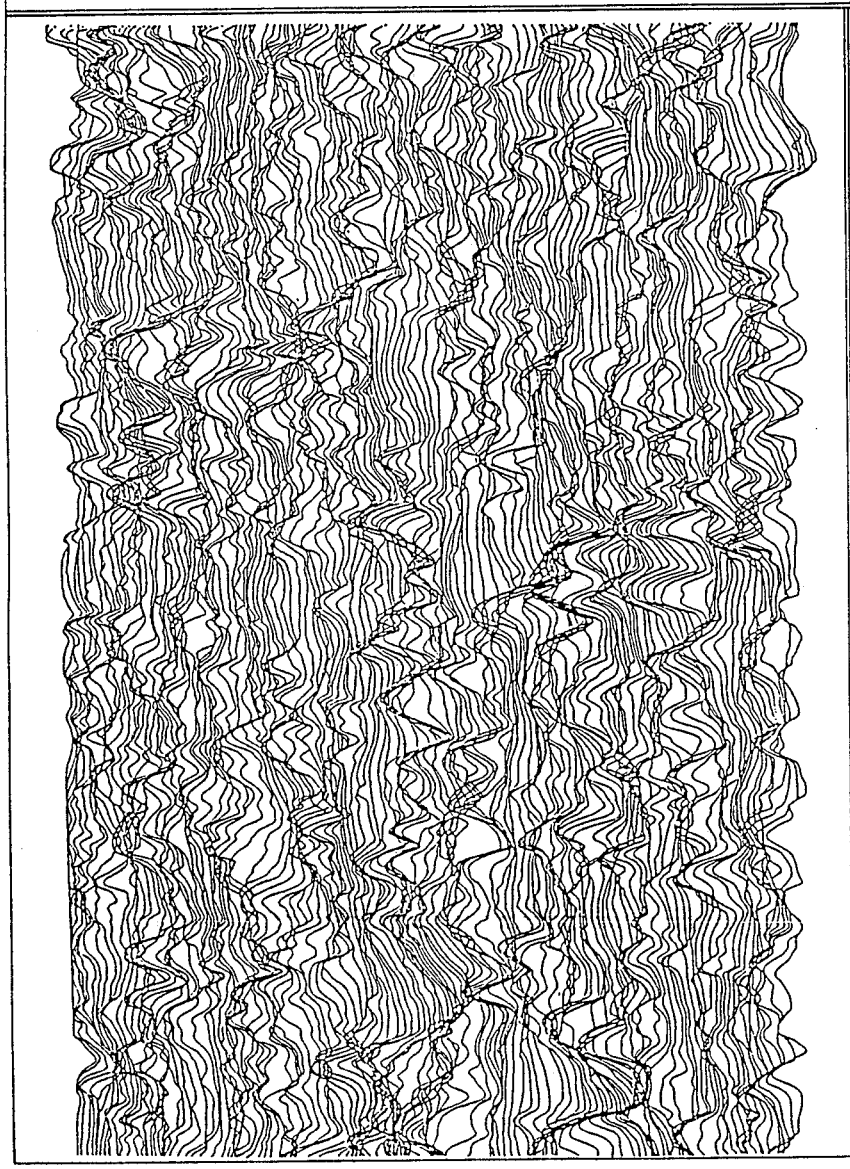
FIG. 2 PRIOR ART
FIG. 2 is a view illustrating a three-dimensional profile of surface roughness in a work roll dulled through the conventional shot blast process.
Figure 3:
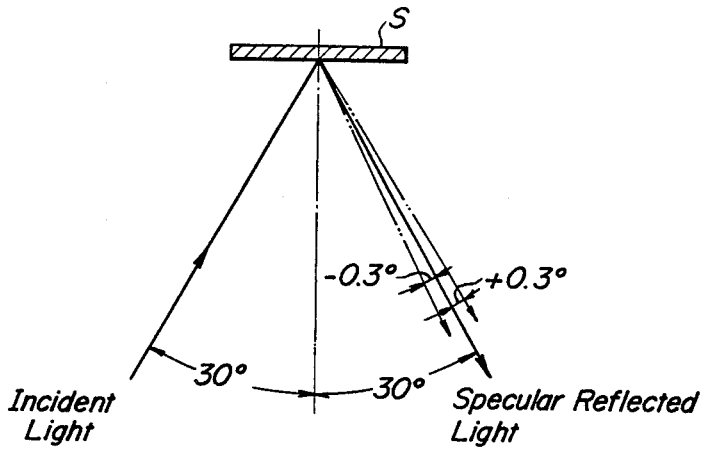
FIG. 3 is a schematic view showing the measurement of DOI value as a distinctness of image.
Figure 4:
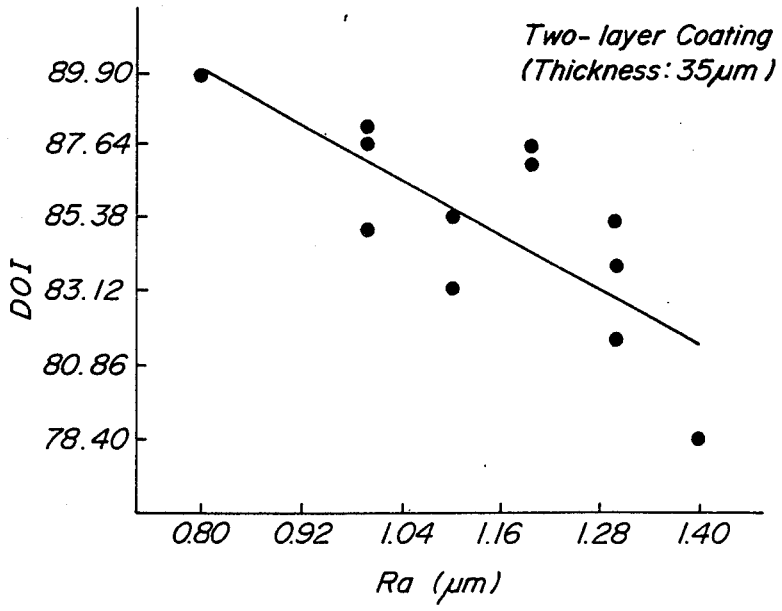
Figure 5:
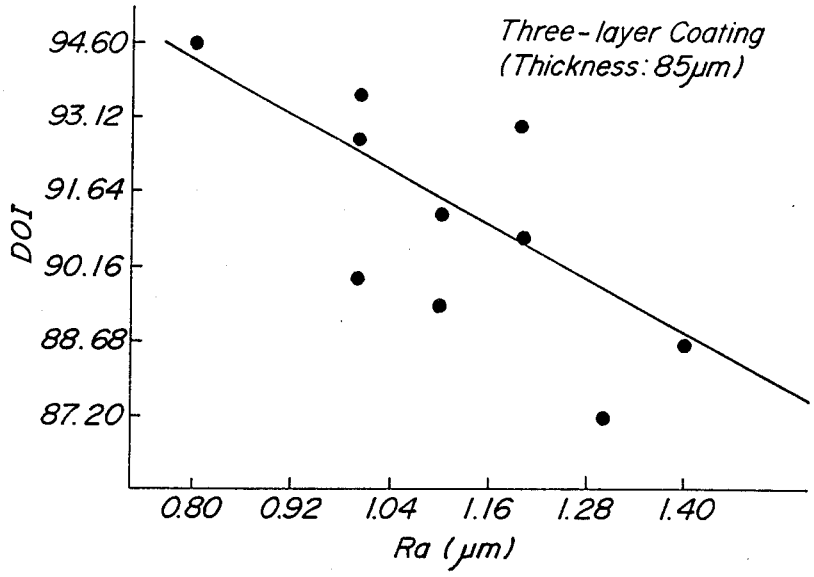

As previously mentioned, it is desirable that the DOI value as a distinctness of image after painting is not less than 94. In the above example, it is apparent from FIG. 1 that when Ra is not more than 2.0 μm, the DOI value of not less than 94 is obtained in the sample A of LD material. Further, since the highest painting quality is required in high-grade cars, it is desired that the DOI value is not less than 98. In this connection, the DOI value of not less than 98 is obtained in the sample B of LD material as shown in FIG. 31.

Moreover, it has been confirmed from the press forming test of outer panel for automobile that the galling is not caused in the press forming of the sample B of LD material, and when Ra is less than 0.3 μm, the galling frequently occurs in the press forming.

In the painting steel sheets according to the invention, remarkable effect capable of more improving the distinctness of image after painting is obtained without damaging the press formability. According to the method of the invention, the steel sheets having an improved distinctness of image after painting can be produced in practice.

What is claimed is:

1. A steel sheet for painting, characterized in that a center-line average surface roughness Ra of said steel sheet is within a range of 0.3 to 3.0 μm and a microscopic shape constituting said surface roughness is comprised of trapezoidal mountain portions having a flat top surface, groove-like valley portions formed so as to surround a whole or a part of the mountain portion and middle flat portions formed between the mountain portions outside the valley portion so as to be higher than the bottom of the valley portion and lower than or equal to the top surface of the mountain portion and satisfies the following relations:

$$0.85 \leqq Sm/D \leqq 3.0$$

$$Sm - D < 450 \text{ (pm)}$$

$$30 \leqq do \leqq 500 \text{ (μm)}$$

$$20 \leqq \eta \leqq 95 \text{ (\%)},$$

wherein Sm is a mean center distance between the adjoining mountain portions, D is a mean diameter in the outer periphery of the valley portion, $d_0$ is a mean diameter in the flat top surface of the mountain portion, and $\eta$ is a ratio of a sum of areas in the flat top surface of the mountain portion and areas in the flat surface of the middle flat portion to a whole area of the steel sheet.

2. A method of producing steel sheets for painting, which comprises subjecting a surface of a work roll for temper rolling to a dulling of surface pattern comprised of a combination of fine crater-like concave portions and ring-like convex portions upheaving at the outer peripheral edge of the concave portion and having a ratio of mean center distance (Sm) between adjoining convex portions to diameter (D) in the outer peripheral edge of the concave portion of 0.85–3.0 and a difference between Sm and D of less than 450 μm through a high density energy source, and then temper rolling a steel sheet with a pair of work rolls, at least one of which being the above dulled work roll, at a draft (λ) of not less than 0.3% to transfer the pattern of the dulled work roll to the surface of the steel sheet.

3. The method according to claim 2, wherein said high density energy source is a laser.

* * * * *